US011715339B1

(12) United States Patent
Hilmas et al.

(10) Patent No.: US 11,715,339 B1
(45) Date of Patent: Aug. 1, 2023

(54) ELECTRONIC LOCKBOX WITH KEY RETAINER SUBASSEMBLY

(71) Applicants: Aric T. Hilmas, Louisville, CO (US); Gary Franklin Skinner, Broomfield, CO (US); Michael W. Aumock, Broomfield, CO (US); Joe Bucciaglia, Boulder, CO (US)

(72) Inventors: Aric T. Hilmas, Louisville, CO (US); Gary Franklin Skinner, Broomfield, CO (US); Michael W. Aumock, Broomfield, CO (US); Joe Bucciaglia, Boulder, CO (US)

(73) Assignee: ARMADILLO SYSTEMS, LLC, Louisville, CO (US)

( * ) Notice: Subject to any disclaimer, the term of this patent is extended or adjusted under 35 U.S.C. 154(b) by 0 days.

(21) Appl. No.: 16/570,853

(22) Filed: Sep. 13, 2019

Related U.S. Application Data

(60) Provisional application No. 62/730,619, filed on Sep. 13, 2018.

(51) Int. Cl.
*G07C 9/00* (2020.01)
*G07C 9/20* (2020.01)
(Continued)

(52) U.S. Cl.
CPC ..... *G07C 9/00309* (2013.01); *E05B 47/00* (2013.01); *E05B 67/02* (2013.01);
(Continued)

(58) Field of Classification Search
CPC ..... E05B 19/00; E05B 67/02; E05B 47/00; E05B 67/22; G07C 9/00309;
(Continued)

(56) References Cited

U.S. PATENT DOCUMENTS 4,831,374 A 5/1989 Masel
5,245,652 A * 9/1993 Larson ..... G07C 9/21 379/102.06
(Continued)

FOREIGN PATENT DOCUMENTS

CN 203016289 U 6/2013
CN 103637571 A 3/2014
(Continued)

*Primary Examiner* — Brian E Miller
(74) *Attorney, Agent, or Firm* — Red Rocks Law LLC

(57) ABSTRACT

Disclosed herein are various embodiments of an electronic lockbox for storing keys and key cards. The lockbox may include calendar-based entry rules so that the key codes can differ based on the date and time. The lockbox may be controllable by a mobile device such as a mobile phone, tablet, or other mobile device. The lockbox may include functionality so that key codes for the lockbox can be transmitted via websites such as Airbnb, HomeAway, or other rental websites, so that guests automatically receive their unique lockbox codes when they confirm their reservations. The lockbox may also receive a Bluetooth low energy virtual key which may be transmitted directly from a user's mobile phone to the lockbox, so that no manual code entry through the keypad is required by a user. The lockbox may be capable of accepting multiple passcodes enabled at different times and dates, and for different purposes.

16 Claims, 28 Drawing Sheets

(51) Int. Cl.

| | |
|---|---|
| ***E05B 47/00*** | (2006.01) |
| ***E05B 67/02*** | (2006.01) |
| *E05B 19/00* | (2006.01) |
| *E05B 67/22* | (2006.01) |

(52) U.S. Cl.
CPC ..... *G07C 9/00817* (2013.01); *G07C 9/00944* (2013.01); *G07C 9/215* (2020.01); *E05B 19/00* (2013.01); *E05B 67/22* (2013.01); *G07C 2009/00825* (2013.01); *G07C 2009/00841* (2013.01); *G07C 2009/00952* (2013.01)

(58) Field of Classification Search
CPC ..... G07C 9/00817; G07C 9/215; G07C 9/00944; G07C 2009/00825; G07C 2009/00841; G07C 2009/00952
See application file for complete search history.

(56) References Cited

U.S. PATENT DOCUMENTS 5,280,518 A * 1/1994 Danler ..... G07C 9/00857 379/102.06
5,383,938 A 1/1995 Rohr et al.
5,602,536 A * 2/1997 Henderson ..... G07C 9/00817 340/5.23
6,317,313 B1 * 11/2001 Mosgrove ..... G07C 9/00944 361/679.3
6,526,786 B1 * 3/2003 Kayoda ..... E05B 19/0005 70/14
6,727,801 B1 * 4/2004 Gervasi ..... E05B 19/0005 340/5.3
6,791,450 B2 9/2004 Gokcebay et al.
6,879,243 B1 4/2005 Booth et al.
7,009,489 B2 * 3/2006 Fisher ..... G07C 9/00912 340/5.7
7,086,258 B2 * 8/2006 Fisher ..... E05B 19/0005 70/24
7,420,456 B2 * 9/2008 Fisher ..... E05B 19/0005 340/5.28
8,040,218 B2 * 10/2011 Hays ..... G07C 9/00309 340/5.73
8,093,986 B2 1/2012 Harvey
8,754,744 B2 * 6/2014 Woodard ..... G06Q 10/00 340/5.28
8,786,400 B2 * 7/2014 Harkins ..... G07C 9/27 340/5.2
8,789,884 B1 * 7/2014 Edelman ..... A47C 7/72 297/188.13
8,912,884 B2 * 12/2014 Fisher ..... G07C 9/00896 340/5.73
8,970,344 B2 3/2015 Payson et al.
9,194,157 B2 * 11/2015 Bahar ..... E05B 19/0005
9,208,456 B2 * 12/2015 McGinn ..... G06Q 30/02
9,208,466 B2 * 12/2015 Fisher ..... G06Q 10/08
9,526,010 B2 * 12/2016 Chung ..... G07C 9/00309
9,540,845 B1 * 1/2017 Yang ..... E05B 19/0005
9,659,424 B2 * 5/2017 Huber ..... G07C 9/00174
9,670,694 B2 * 6/2017 Larson ..... G07C 9/00309
9,761,071 B2 * 9/2017 Woodard ..... G06Q 50/16
9,771,737 B1 * 9/2017 Rais ..... E05B 19/0005
10,017,960 B2 * 7/2018 Kristensen ..... E05B 19/0005
2003/0179075 A1 * 9/2003 Greenman ..... G07C 9/00896 340/5.54
2005/0199628 A1 * 9/2005 Van Handel ..... A47G 29/10 220/315
2005/0206499 A1 * 9/2005 Fisher ..... E05B 47/0603 340/5.73
2006/0162403 A1 * 7/2006 Handel ..... A47G 29/10 70/63
2008/0252415 A1 * 10/2008 Larson ..... G07C 9/00309 340/5.73
2009/0121836 A1 5/2009 Mikan et al.
2009/0153291 A1 * 6/2009 Larson ..... G07C 9/00896 340/5.33
2009/0293562 A1 * 12/2009 Fisher ..... E05B 19/0005 70/278.7
2011/0251876 A1 * 10/2011 Fisher ..... G06Q 30/0216 705/7.32
2012/0060570 A1 * 3/2012 Yang ..... E05B 19/0005 70/63
2012/0119877 A1 * 5/2012 Ng ..... G07C 9/00571 340/5.61
2013/0000366 A1 1/2013 Martel et al.
2013/0151267 A1 6/2013 Mehdizadeh
2014/0375422 A1 * 12/2014 Huber ..... G07C 9/00571 340/5.61
2015/0022315 A1 * 1/2015 Ng ..... E05B 19/0005 340/5.22
2015/0069799 A1 * 3/2015 Edelman ..... A47C 7/622 297/188.01
2015/0186840 A1 7/2015 Torres et al.
2016/0005284 A1 1/2016 Batra et al.
2016/0053526 A1 2/2016 Dittrich
2016/0105644 A1 4/2016 Smith et al.
2016/0180621 A1 * 6/2016 Desinor, Jr. ..... G07C 9/00896 340/5.61
2017/0103597 A1 * 4/2017 Fisher ..... G07C 9/00309
2017/0208711 A1 * 7/2017 Yang ..... E05B 67/22
2017/0234057 A1 * 8/2017 Yardley ..... E05B 65/0075 109/56
2017/0256111 A1 * 9/2017 Chung ..... G07C 9/00896
2017/0372542 A1 * 12/2017 Romero ..... G07C 9/00896
2018/0190056 A1 * 7/2018 Desinor, Jr. ..... G07C 9/00896
2019/0076909 A1 * 3/2019 Page ..... B21D 43/22
2019/0234113 A1 * 8/2019 Neau ..... E05B 67/383
2019/0345735 A1 * 11/2019 Melikian ..... A47G 29/10
2020/0308870 A1 * 10/2020 Fisher ..... E05G 1/005
2020/0312067 A1 * 10/2020 Fisher ..... E05G 1/10

FOREIGN PATENT DOCUMENTS

WO WO1980002710 A1 12/1980
WO WO2016030857 A1 3/2016

* cited by examiner

50

Riad Farnatchi open

Ko Samui open

Saint Barthélemy open

250

260

280

290

300

310

ELECTRONIC LOCKBOX WITH KEY RETAINER SUBASSEMBLY

CROSS-REFERENCE TO RELATED APPLICATION

This application claims priority to and the benefit of, under 35 U.S.C. 119(e), U.S. provisional patent application No. 62/730,619 filed Sep. 13, 2018 entitled "Electronic Lockbox" the disclosure of which is hereby incorporated by reference in its entirety.

TECHNICAL FIELD

This application relates, in general, to lockboxes, and more specifically to electronic lockboxes.

BACKGROUND

Traditionally, lockboxes are used by real estate agents and others to provide a secure means for storing keys, for instance keys for a home or other dwelling. These lockboxes conventionally in one example may include rotary mechanical dials for a user to open the lockbox to access the content within the lockbox. One problem with conventional lockboxes of this type is that the unlock code for the lockbox is static, and therefore can make the lockbox subject to unauthorized access if the static unlock code is obtained by an unauthorized user.

Accordingly, as recognized by the present inventors, what is needed is an electronic lockbox with dynamic lock and unlock codes that can be set, changed, managed, and monitored remotely by authorized users.

SUMMARY

In light of the above and in accordance with one broad aspect of an embodiment of the present disclosure, disclosed herein are various embodiments of an electronic lockbox for storing keys and key cards, and which may be controlled using an application program operating on a mobile device such as a smartphone over a wireless communication link. The lockbox may include calendar-based entry rules so that the key codes can differ based on the date and time. The lockbox may be controllable by a mobile device such as a mobile phone, or tablet, or other mobile device, and may support platforms such as IOS, android, PC, Mac, and others. An optional Wi-Fi bridge device or gateway device may also be provided to communicate with both the lockbox (over a wireless link such as Bluetooth), and also with a building's or home's internet connection—thereby allowing the lockbox to communicate wirelessly with the internet connection of a home or building. The lockbox may include oversize buttons, and may include functionality so that key codes for the lockbox can be transmitted via websites such as Airbnb, HomeAway, or other rental websites, so that guests automatically receive their unique lockbox codes when they confirm their reservations. The lockbox may utilize a multi-digit access code so as to improve the code security of the lockbox, such as a seven digit access code. The lockbox may also receive a low-energy Bluetooth virtual key which may be transmitted directly from a user's mobile phone to the lockbox, so that no manual code entry through the keypad is required by a user. In one example, the lockbox may be capable of accepting multiple passcodes enabled at different times and dates, and for different purposes, such as a unique passcode for access by a cleaning crew, and a different unique passcode for tenants or guests. Key codes are passcodes may also be entered directly from a keypad. In one example, the lockbox may be formed utilizing metal construction with a silicone cover.

According to another broad aspect of another embodiment of the present disclosure, disclosed herein is an electronic lockbox for storing an item. In one example, the lockbox may include a housing defining an interior, the housing including a front cover and a baseplate; a hinge connecting the front cover with the baseplate; and a key retainer subassembly located within the interior of the housing. In one example, the key retainer subassembly has at least one cavity to receive a key, and may have at least one cavity to receive a key card.

In one embodiment, the lockbox may include an electronically controllable latch to selectively secure the cover with the baseplate into a locked state or unlocked state. The latch may be positioned within and connected with the cover. The baseplate may include one or more fixed protruding receiving members, and the latch may include one or more pins that selectively extend outwardly to engage the fixed protruding receiving members, in order to secure the cover to the baseplate.

In one example, the lockbox may also include a microprocessor electronically coupled with the latch; and a Bluetooth or other wireless interface coupled with the microprocessor to receive codes (i.e., unlock codes) from one or more external devices to control the lockbox. The external devices may include a user's mobile device (i.e., phone or tablet) or user's computer (laptop or desktop). The external device may also include a gateway device adapted to be coupled with a home's internet connection.

In one example, the lockbox may log one or more codes received by the lockbox, including the date and time said one or more codes were received—which enables a property owner or property manager to monitor and audit codes that others are using to access or attempt to access the lockbox.

The lockbox may also receive data specifying a date range and a time range associated with unlock codes—for instance, when the property owner, property manager, or property rental website sets unlock codes for the lockbox. In this manner, the property owner, property manager, or property rental website can set time windows or date ranges when an unlock code is valid to open the lockbox.

In another embodiment, a lockbox may also include an interface bus to couple with a video camera expansion module to capture one or more images of the surrounding environment proximate the lockbox, wherein upon capturing said one or more images, the lockbox transmits the one or more images over a network.

In accordance with another broad aspect of another embodiment of the present disclosure, disclosed herein is an electronic lockbox for storing one or more keys. In one example, the lockbox may include a housing defining an interior, the housing including a front cover and a baseplate; a hinge connecting the front cover with the baseplate; an electronically controllable latch to selectively secure the cover with the baseplate into a locked state or unlocked state; a microprocessor electronically coupled with the latch; and a wireless interface coupled with the microprocessor to receive codes from one or more external devices to control the lockbox. The lockbox may include one or more features, structures or processes disclosed herein.

In accordance with another broad aspect of another embodiment of the present disclosure, disclosed herein is a system for a home, where the system may include an electronic lockbox for storing items, the lockbox including a wireless (i.e., Bluetooth) interface; and a gateway device including a network port adapted to connect with the home's internet connection, the gateway device further comprising a wireless interface to communicate with the lockbox.

In one example, the network connection of the gateway device to the home's internet connection may utilize a wi-fi connection, or may use a wired connection. The lockbox may be adapted to communicate with a user's mobile phone using a wireless connection (i.e., Bluetooth) to receive a code from the user's mobile phone to unlock the lockbox. The lockbox may be adapted to communicate with an owner's mobile computing device over a network to receive a new unlock code through the gateway device. The lockbox may also be adapted to communicate with a rental property website over a network to receive a new unlock code from the rental property website through the gateway device.

Other embodiments of the disclosure are described herein. The features, utilities and advantages of various embodiments of this disclosure will be apparent from the following more particular description of embodiments as illustrated in the accompanying drawings.

DETAILED DESCRIPTION

Figure 1:
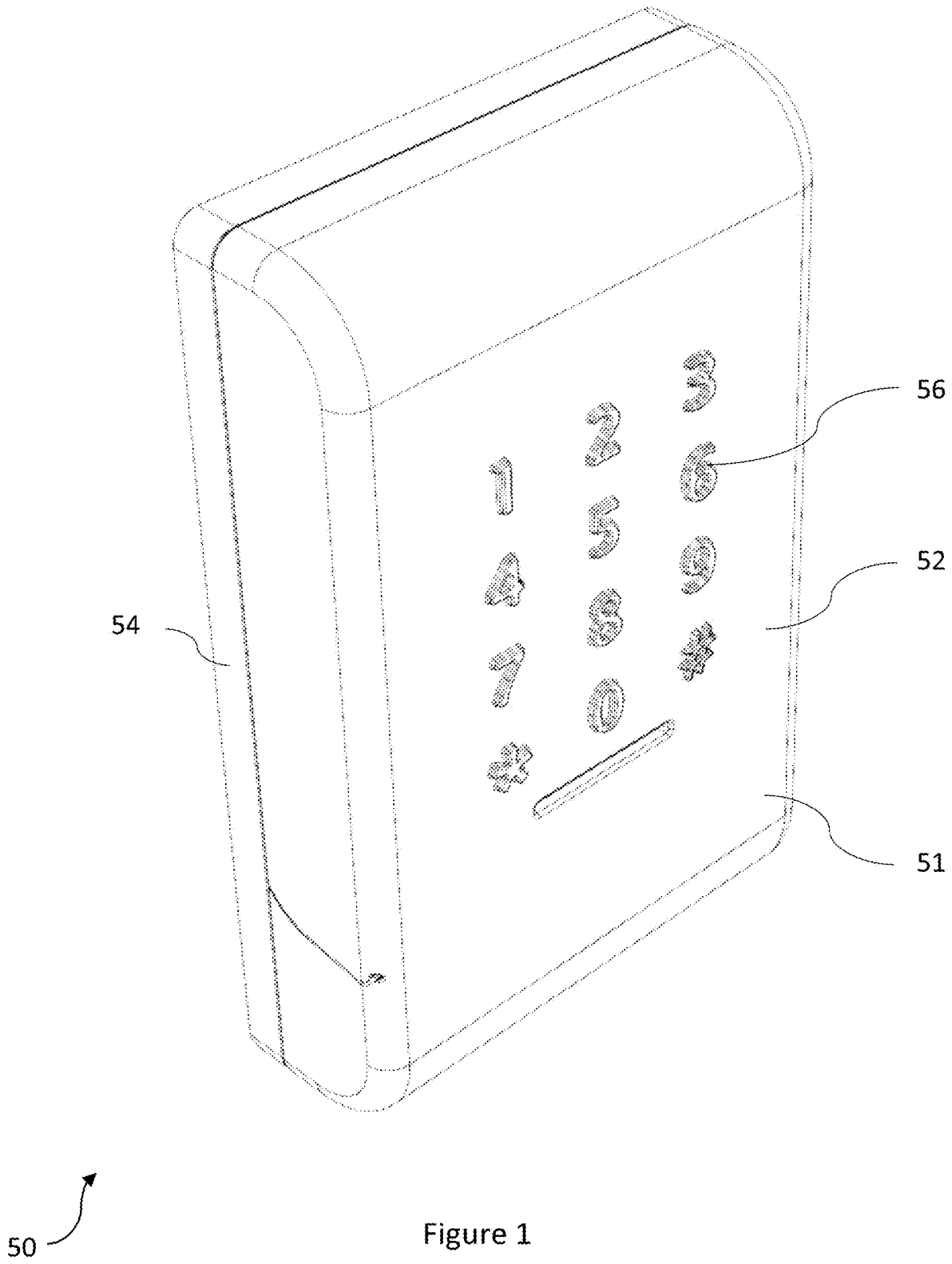
FIG. 1 illustrates a perspective view of an example of an electronic lockbox in a closed/locked state, in accordance with one embodiment of the present disclosure.
Figure 2:
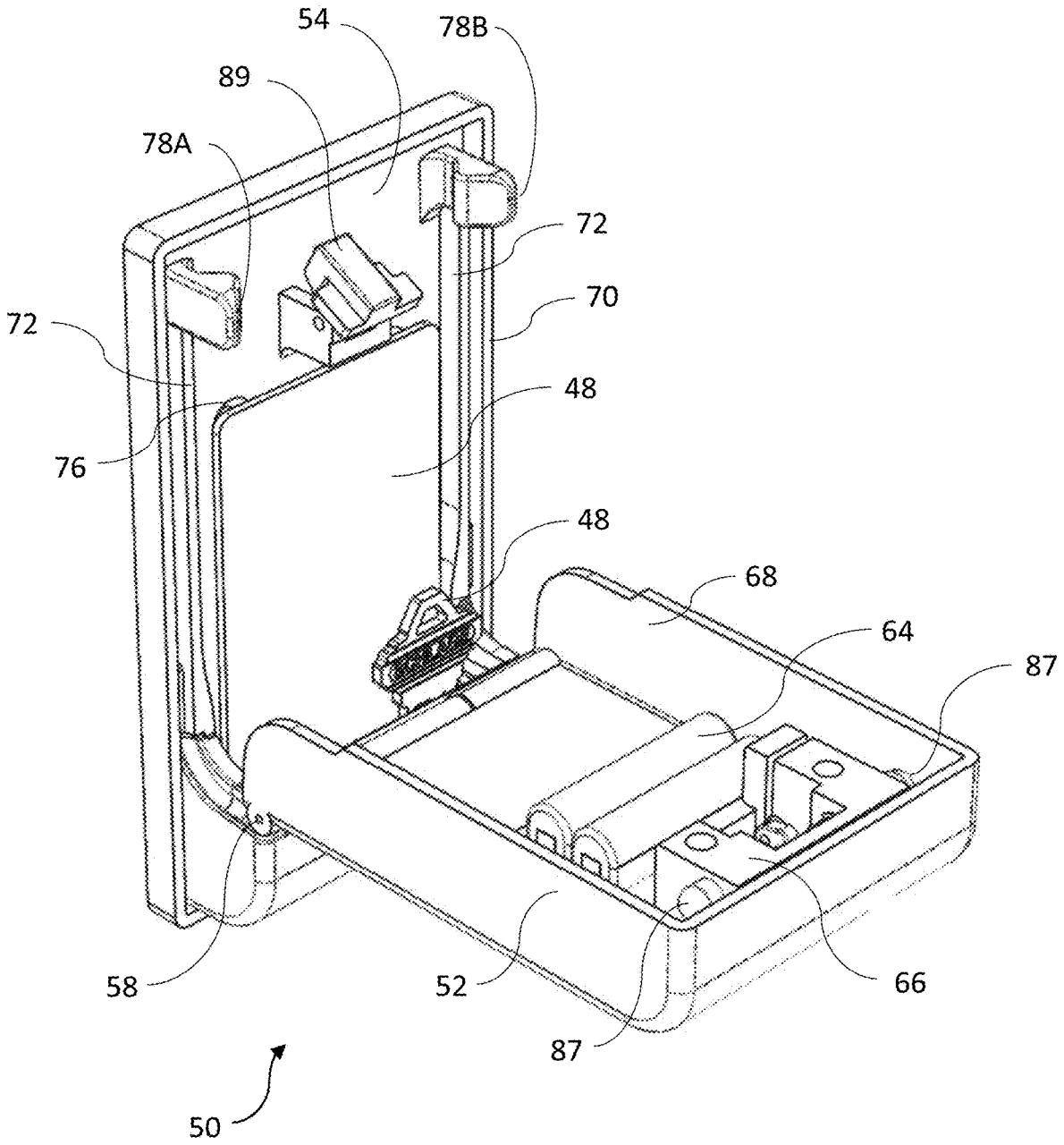
FIG. 2 illustrates an example of an electronic lockbox in an open/unlocked state, in accordance with one embodiment of the present disclosure.

Disclosed herein are various embodiments of an electronic lockbox for securely storing items such as keys and or key cards or other items, for access by a user such as a tenant, guests, visitor, or other person of a property such as a home, condominium, apartment, office, or other dwelling, building or structure. As will be described herein, an electronic lockbox may be opened using a valid access code typed into a keypad of the lockbox, or via a valid electronic code transmitted from a mobile device such as a mobile smartphone over a wireless link (i.e., Bluetooth, LPWAN, Zigbee, or other conventional wireless link) to the electronic lockbox.

The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the embodiments. Many other embodiments may be utilized for practicing the subject matter other than the illustrative examples discussed herein, and many structural and operational changes in addition to the alternatives specifically discussed herein may be made without departing from the scope of the disclosed subject matter.

In this description, references to "one embodiment" or "an embodiment," or to "one example" or "an example" mean that the feature being referred to is, or may be, included in at least one embodiment or example of the disclosure. Separate references to "an embodiment" or "one embodiment" or to "one example" or "an example" in this description are not intended to necessarily refer to the same embodiment or example; however, neither are such embodiments mutually exclusive, unless so stated or as will be readily apparent to those of ordinary skill in the art having the benefit of this disclosure. Thus, the present disclosure includes a variety of combinations and/or integrations of the embodiments and examples described herein, as well as further embodiments and examples as defined within the scope of all claims based on this disclosure, as well as all legal equivalents of such claims.

FIGS. 1-30 illustrate various aspects of an electronic lockbox in accordance with embodiments of the present disclosure. Referring to FIGS. 1-2 and 22-30, an electronic lockbox 50 may include a housing 51 which may be made of rigid material such as metal or other material including composites, rubber, plastic or other material. Housing 51 may include a rotatable front cover 52 and a base plate 54 that can be mounted on a surface or wall, for instance using screws. Front cover 52 may include a keypad 56 with oversized buttons which may be made of silicone in one example.

A hinge 58 with hinge pin 60 may be utilized to connect the rotatable front cover 52 to the base plate 54 so that rotatable front cover 52 rotates about hinge 58 when lockbox 50 is opened. Within the interior of housing 51, a key retainer subassembly 62 may be provided to store and organize keys/key cards 48 in fixed locations within the lockbox 50.

In one example, front cover 52 includes a keypad 56 on the exterior surface of front cover 52. Front cover 52 may also include on its interior surface, rechargeable batteries 64 which provides power for lockbox 50. An electromechanical latch 66, such as a two-sided latch, may be provided within the interior of front cover 52. Electromechanical latch 66 may include a latch motor 67 (also shown as 88) which can selectively and controllably open and close electronic latch 66.

Front cover 52 may also include interior walls 68 that extend from the front surface of front cover 52. A circuit board 69 may be attached or positioned in the interior portion of front cover 52, wherein circuit board 69 includes one or more of the electronic components or circuitry described herein.

In one example, base plate 54 may include a set of outer walls 70, and a set of inner rails 72, with slots 74 defined between an inner rail 72 and an outer wall 70. Slots 74 may be configured and sized to receive a portion of interior wall 68 of front cover 52 when front cover 52 of lockbox 50 is in a closed or locked position. Inner rails 72, outer walls 70, and interior walls 68 are provided and work in conjunction to protect the contents of lockbox 50 and help reduce the risk that an unauthorized user would pry open lockbox 50 with a screwdriver or other item.

Base plate 54 may also include one or more holes 76 that may be used so that the base plate 54 and lockbox 50 may be mounted on a surface or wall with screws, bolts or other securement items as desired.

Base plate 54 may also include fixed protruding receiving members 78 (78*a*, 78*b*) for receiving the retractable ends 87 of electromechanical latch 66 when latch 66 is in a locked position. Receiving members 78*a,b* include openings or cavities to receive the ends 87 of latch 66 when locked.

In one example and referring to FIGS. 27-30 (and see also FIGS. 2 and 22), an electromechanical latch 66 is shown. In one example, electromechanical latch 66 includes spring-loaded set pins 87*a,b* which are connected with the cover 52. When the cover 52 is being closed relative to base plate 54, pins 87*a,b* engage the interior curved surfaces of fixed protruding receiving members 78*a,b* which are attached to the base plate.

An interference plate 89 is also attached to the base plate 54, and the interference plate 89 is adapted to move or tilt between an upward position and downward position. When interference plate 89 is in the upward position, it may be positioned between the interior ends of set pins 87*a,b* to lock pins 87*a,b* in position (which sets the lockbox in a locked state; see e.g., FIG. 29); or interference plate 89 can be moved/titled downwardly so as to free the interior ends of set pins 87*a,b*, so that pins 87*a,b* can move inwardly to allow the lockbox to be unlocked (see e.g., FIG. 30). Interference plate 89 may be formed of a flexible material, rigid material, or utilize a spring member for positioning.

In one example, interference plate 89 can move or tilt downwardly from a spring-loaded/biased upward default position. After cover 52 is closed and locked relative to base plate 54 (wherein set pins 87*a,b* engage the locked position relative to the interior surfaces of receiving members 78*a,b*), interference plate 89 is adapted to engage set pins 87*a,b* to prevent set pins 87*a,b* from moving inwardly, which locks set pins 87*a,b* against the interior surfaces of receiving members 78*a,b*. Motor 67 (under the control of processor 110) control s the rotary position of cam 91, and cam 91 when rotated can move/tilt interference plate 89 downwardly, which thereby allows pins 87*a,b* to move inwardly, which thereby allows the lockbox cover 52 to be opened relative to baseplate 54 (see, e.g., FIG. 30).

Figure 27:
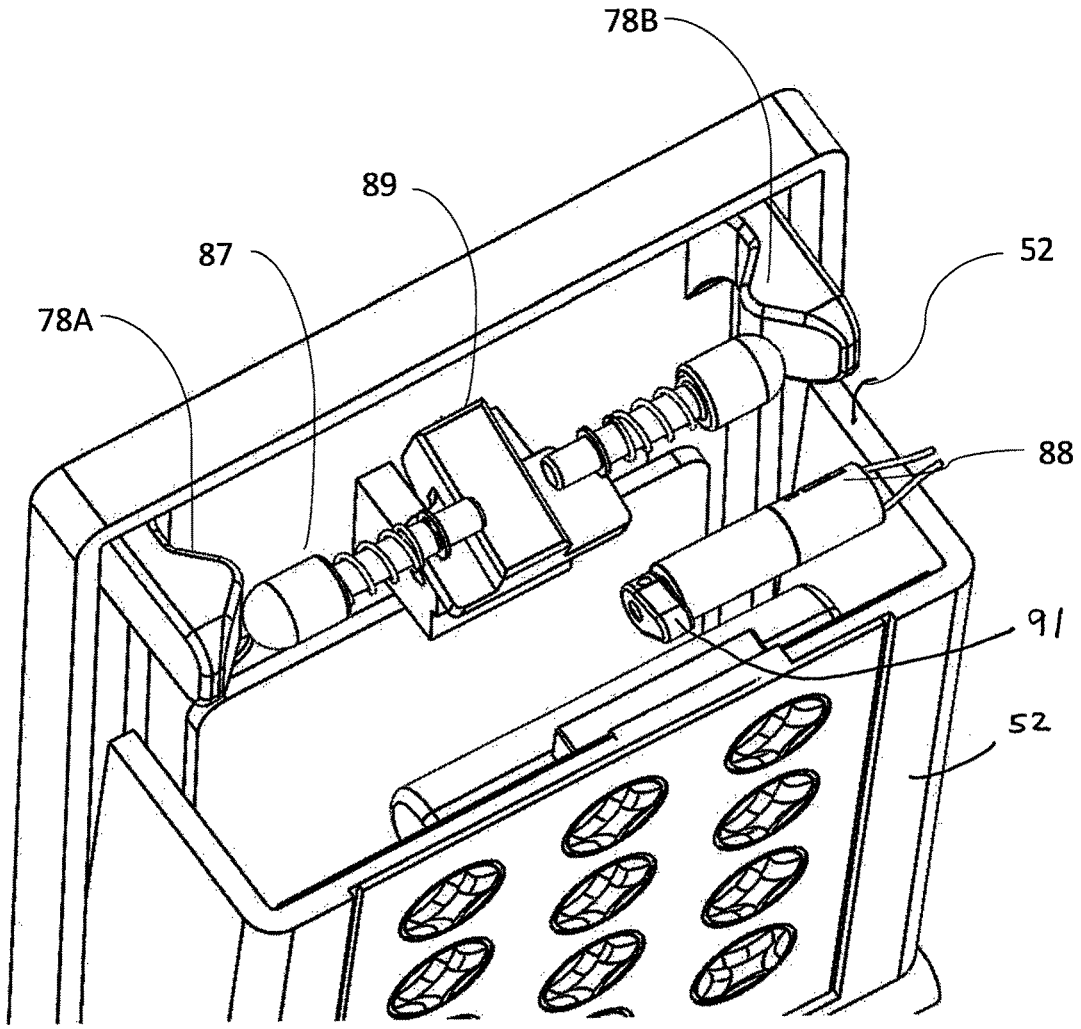
FIG. 27 illustrates a view of an electronically controllable latch of an electronic lockbox, in accordance with one embodiment of the present disclosure.
Figure 28:
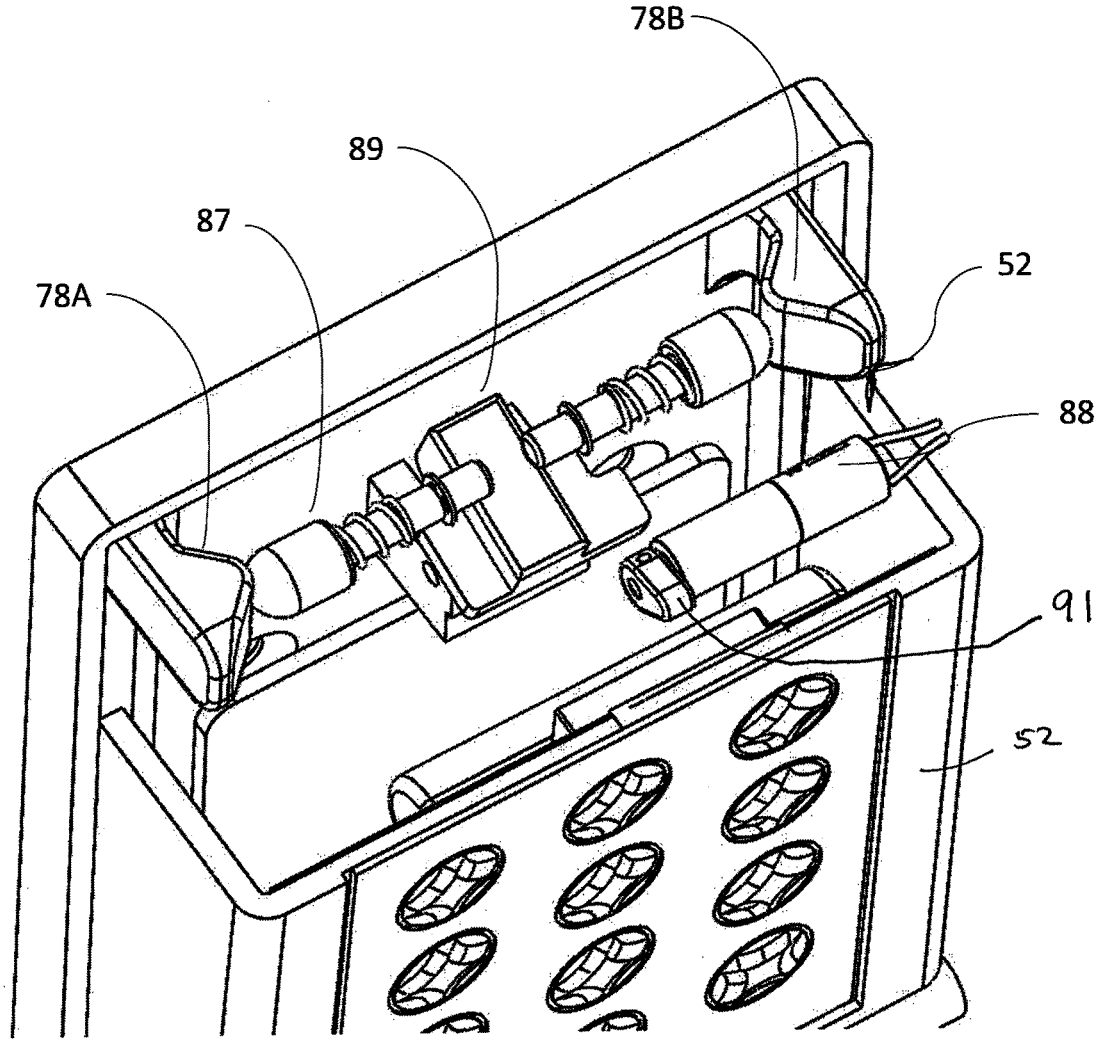
FIG. 28 illustrates another view of an electronically controllable latch of an electronic lockbox, in accordance with one embodiment of the present disclosure.

In FIG. 27, the lockbox is in an open state, wherein set pins/ends 87*a,b* of latch 66 allow the cover 52 to freely move open and close. The set pins 87*a,b* are above the receiving members 78*a,b*. The cam 91 of electric motor 88 is not touching the interference plate 89. FIG. 28 shows the interference plate 89 after movement to the unlocked position, wherein set pin/ends 87*a,b* follow the interior curved surface of receiving members 78*a,b*. The set pins/ends 87*a,b* are forced inward extending over the interference plate 89. As the set pin moves into place the interference plate 89 is temporarily displaced down.

Figure 29:
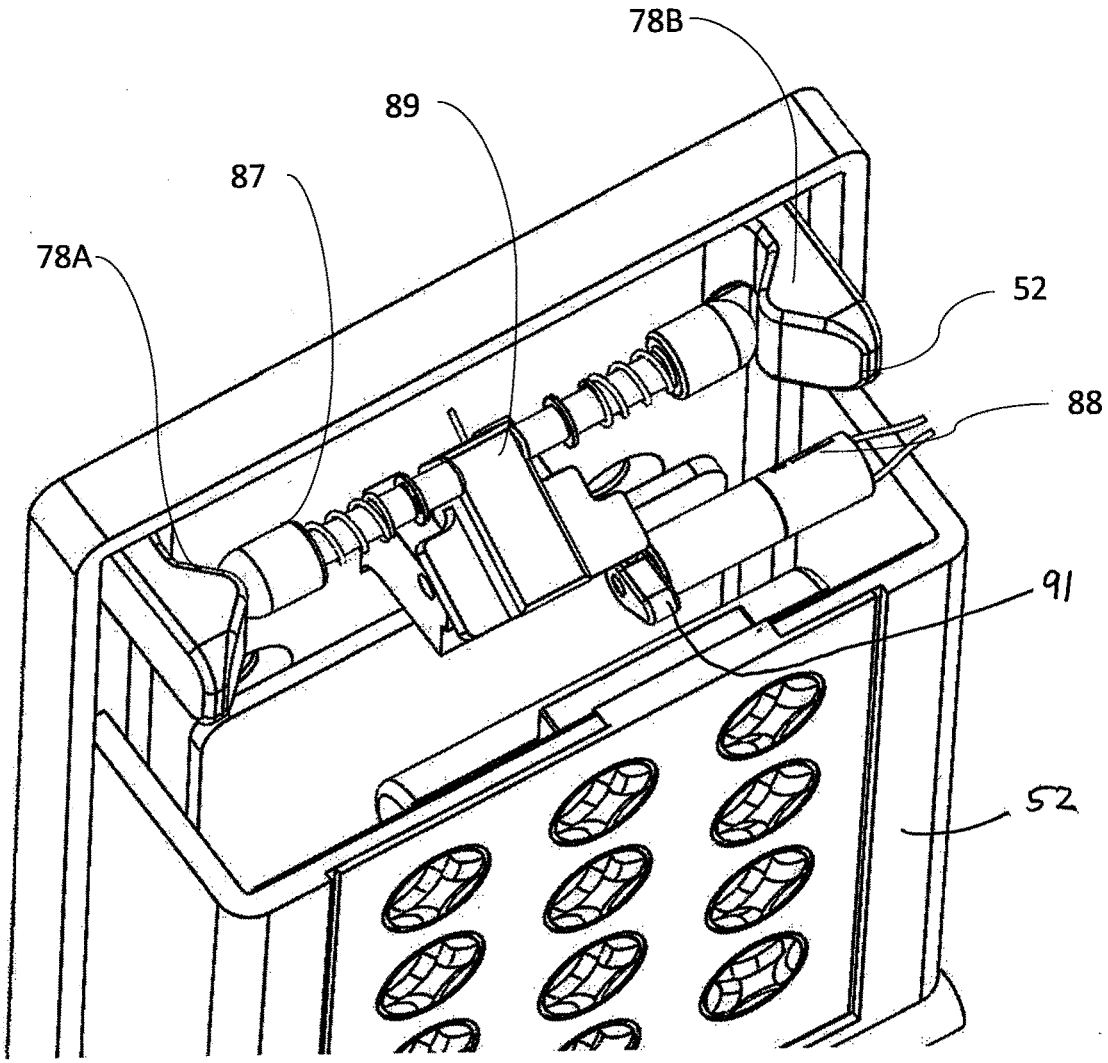
FIG. 29 illustrates another view of an electronically controllable latch of an electronic lockbox in a locked state, in accordance with one embodiment of the present disclosure.
Figure 30:
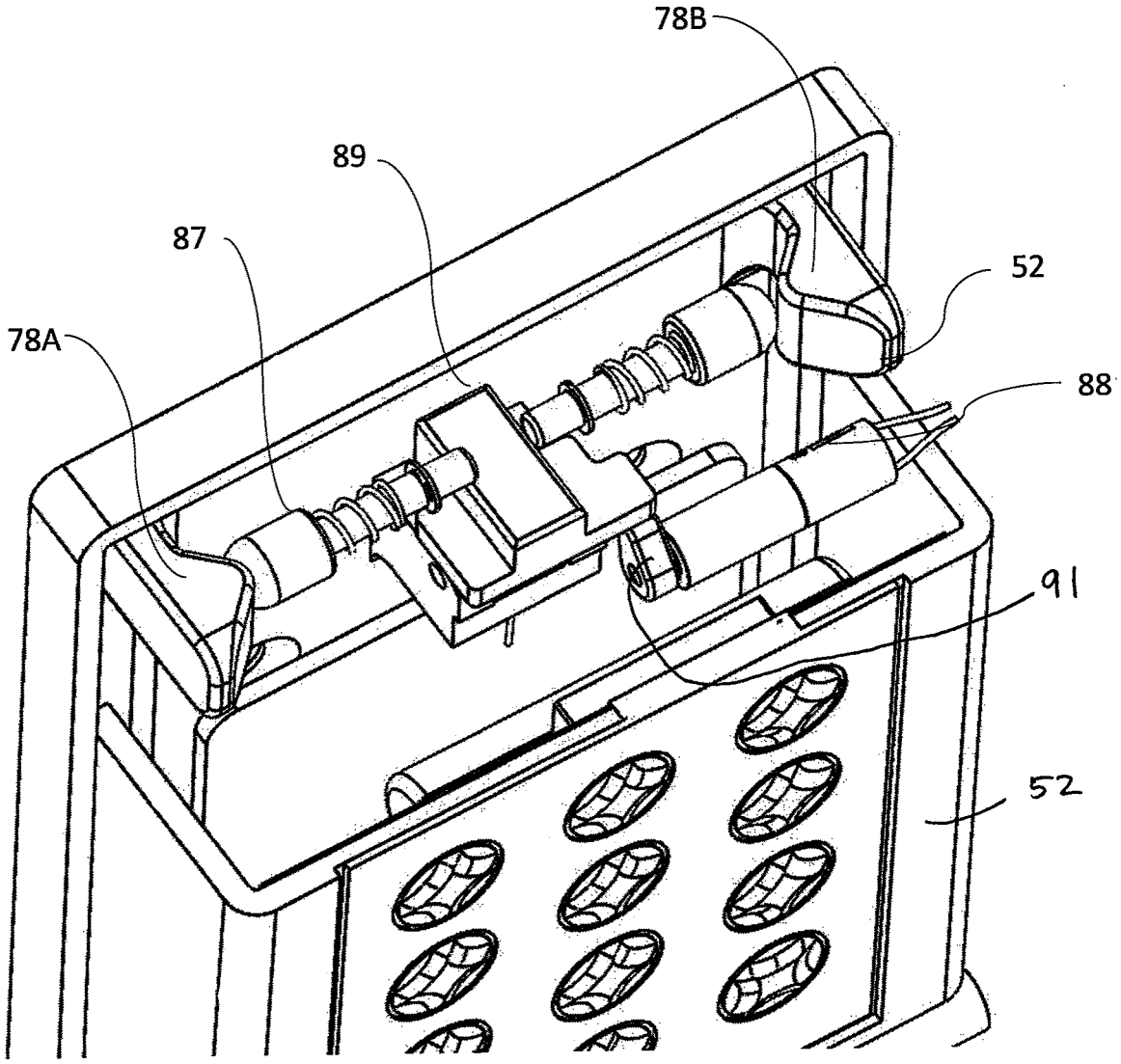
FIG. 30 illustrates another view of an electronically controllable latch of an electronic lockbox in an unlocked state, in accordance with one embodiment of the present disclosure.

In FIG. 29, the electromechanical latch 66 is shown in a locked state, wherein set pin/ends 87*a,b* reside in the receding face of the receiving members 78*a,b*. The interference plate 89 is positioned into its locked or resting position, and interference plate 89 is located between the interior surfaces of pins 87*a,b*, disallowing the set pins/ends 87*a,b* from moving inwardly. In FIG. 30, the electromechanical latch 66 is shown being unlocked, wherein electronic motor 88 (via cam 91) displaces or tilts the interface plate 89 from its resting position. With the interface plate 89 deflected, the set pins/ends 87*a,b* are allowed to move, inwardly, along the interior curved surfaces/faces of receiving members 78*a,b*. When the electronic motor 88 (thru cam 91) releases pressure on the interface plate 89, then interface plate 89 can move to its original upward resting position.

Figure 25:
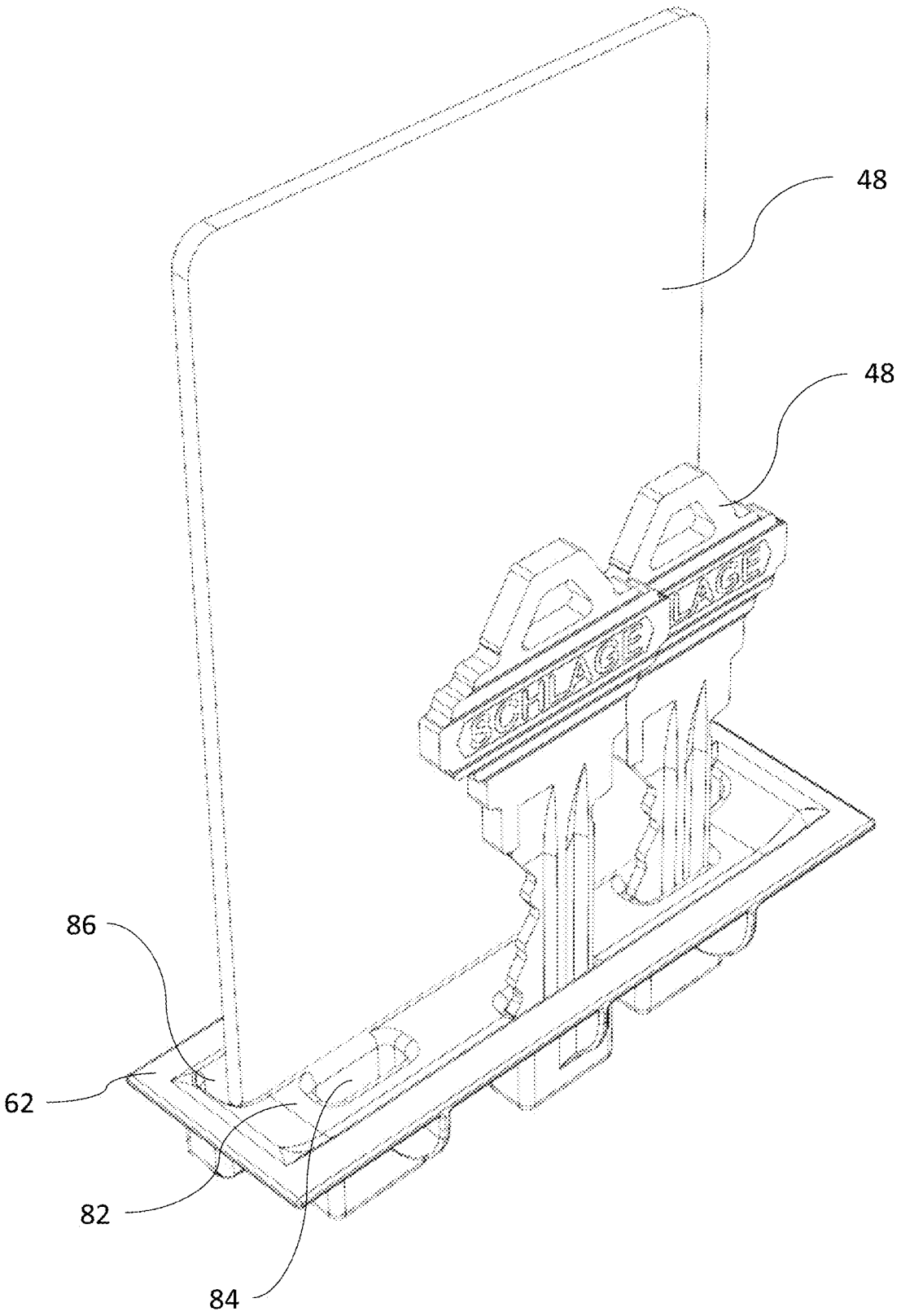
FIG. 25 illustrates an example of items such as keys and key cards inserted in a key retainer subassembly of an electronic lockbox, in accordance with one embodiment of the present disclosure.
Figure 26:
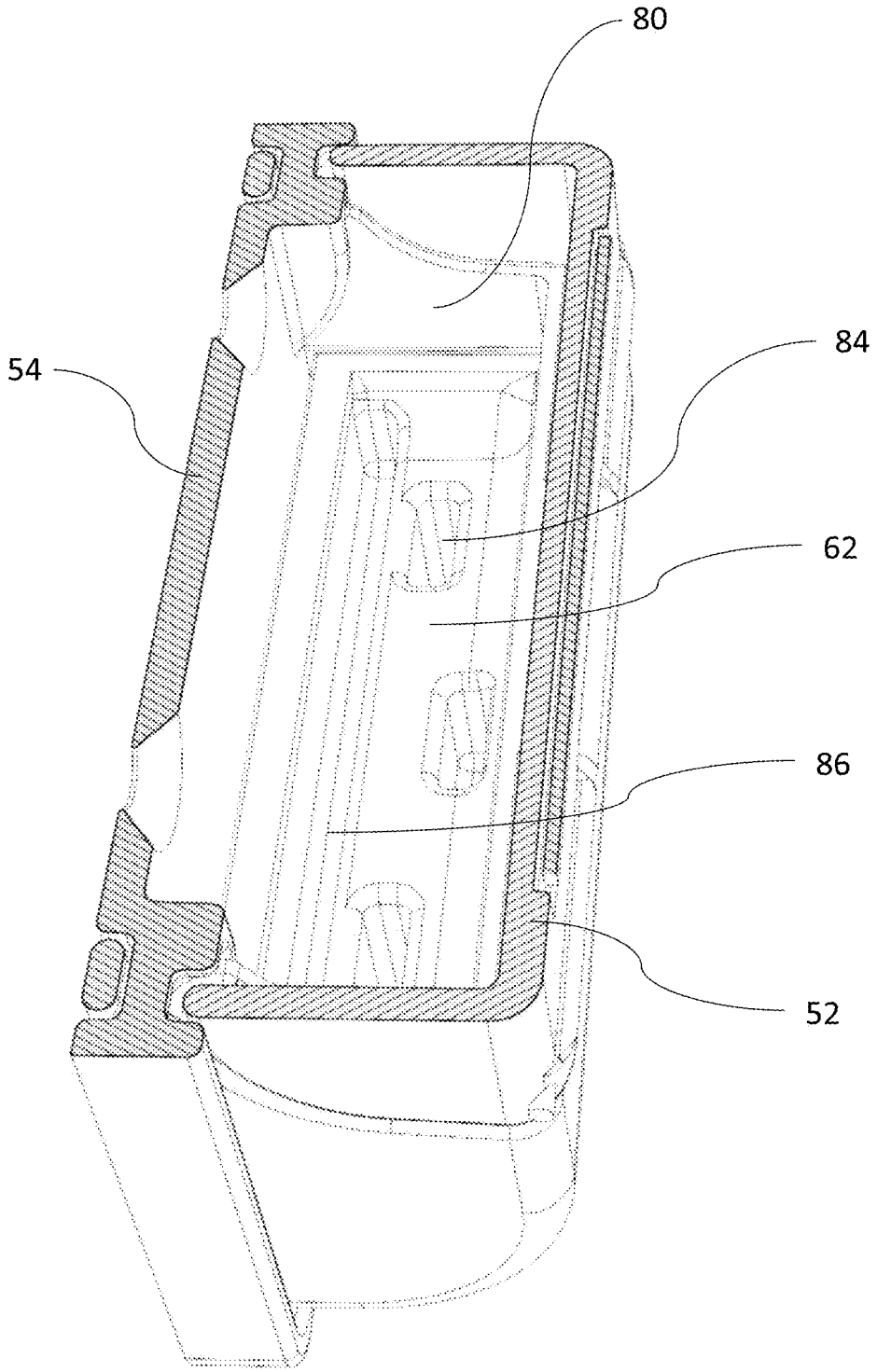
FIG. 26 illustrates a sectional view of an electronic lockbox showing a key retainer subassembly with various cavities to receive keys and/or key cards, in accordance with one embodiment of the present disclosure.

In one example, base plate 54 may also include a cavity 80 to receive key retainer subassembly 62. The key retainer subassembly 62 may be provided within lockbox 52 to removably store and organize keys and key cards 48 within the interior of lockbox 50. As shown in FIGS. 25-26, key retainer subassembly 62 may include an elongated surface 82 with one or more cavities 84 defined within the elongated surface 82, the cavities 84 formed to snugly receive the ends or tips of keys 48. Elongated surface 82 may also include one or more cavities 86 to receive the ends or edges of one or more key cards 48.

Figure 3:
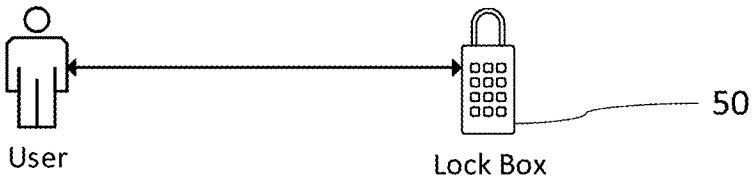
FIG. 3 illustrates a block diagram of a user interacting with an example of an electronic lockbox using a keypad, in accordance with one embodiment of the present disclosure.
Figure 4:
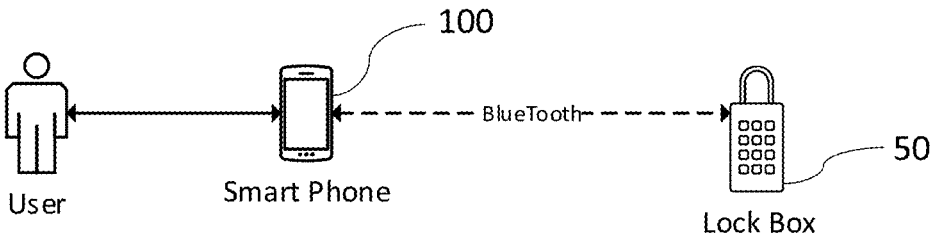
FIG. 4 illustrates a block diagram of a user interacting with an example of an electronic lockbox using the user's mobile device (i.e., smartphone), in accordance with one embodiment of the present disclosure.
Figure 5:
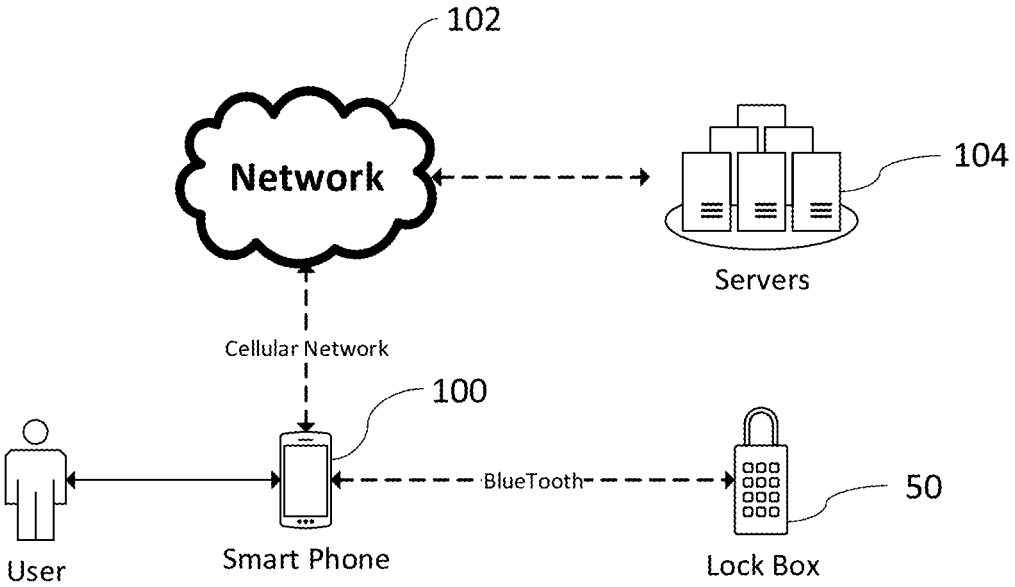
FIG. 5 illustrates a block diagram of a user interacting with an example of an electronic lockbox using the user's mobile device (i.e., smartphone) which may also provide an internet network connection to the lockbox, in accordance with one embodiment of the present disclosure.
Figure 6:
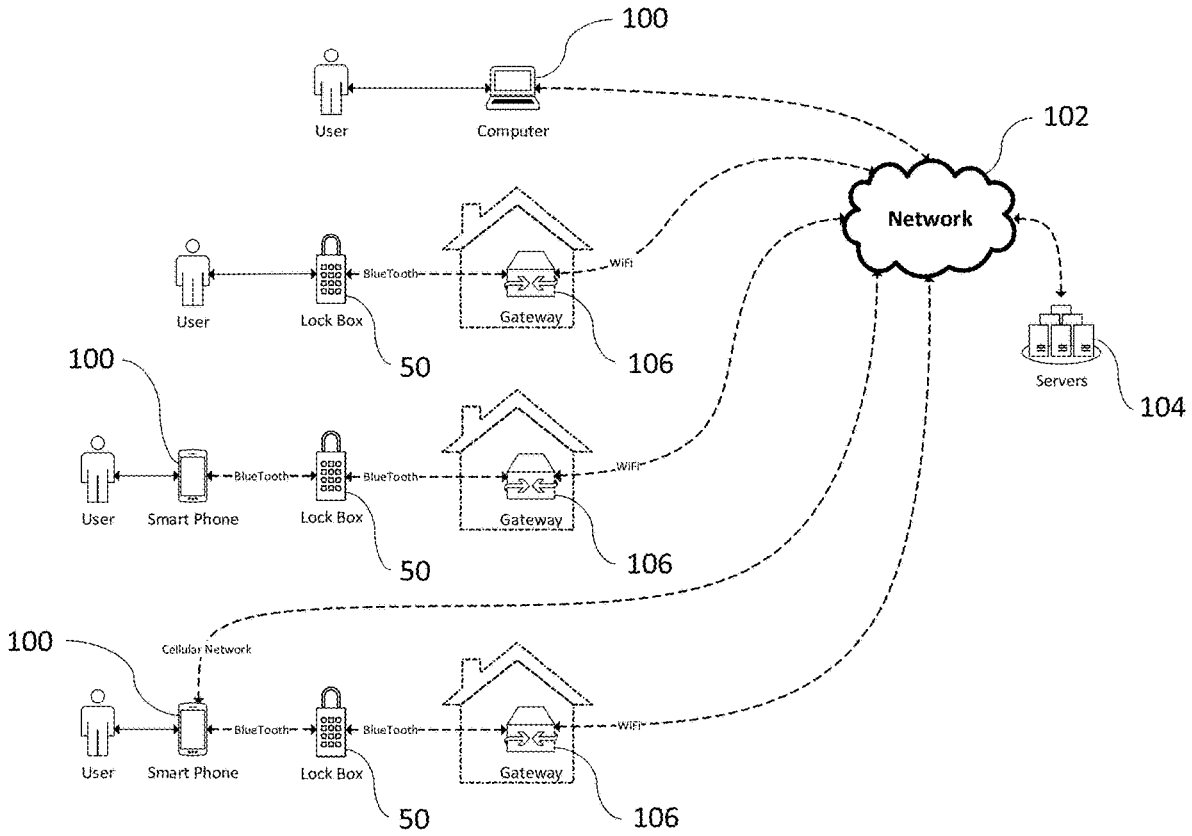
FIG. 6 illustrates a block diagram illustrating various different configurations between a lockbox, gateway device, and a user's device, with a network (such as the internet) and servers, in accordance with one embodiment of the present disclosure.

Electronic lockbox 50 may be controlled and interact with data and access codes in a variety of different manners. FIGS. 3-6 illustrate various configurations in which electronic lockbox 50 may be utilized, in accordance with various embodiments of the present disclosure. In one example as illustrated in FIG. 3, a user may utilize lockbox 50 by typing in a valid access code into the keypad 56 of lockbox 50. In the example of FIG. 4, a user may utilize smart phone 100 (such as through an application program as described herein) to wirelessly transmit a valid and secure access code from smart phone 100 to lockbox 50, in order to control and/or open lockbox 50. In FIG. 5, a user's smart phone 100 through its cellular network 102 can act as a communication link between servers 104 and lockbox 50. In this manner, an authorized user can download access codes for lockbox 50, or read, write, or modify access codes or other data items associated with lockbox 50 as desired. In the example of FIG. 6, a Wi-Fi gateway device 106 can be provided within a home, residence or building and coupled with the Ethernet, network or internet connection of that building to communicate with network 102 to servers 104. Wi-Fi gateway device 106 can communicate with lockbox 50 via a wireless connection/interface (i.e., Bluetooth, LPWAN, Zigbee, or other conventional wireless link), and also communicate with a buildings ethernet/network connection via a wireless links (Wi-Fi) or wired ethernet connections if desired. Servers 104 can be configured to implement one or more of the process steps disclosed herein or other process steps, in order to facilitate management and control of lock codes for lockboxes 50 by owners or property managers, for instance, through the mobile devices of the owners/property managers.

Figure 7:
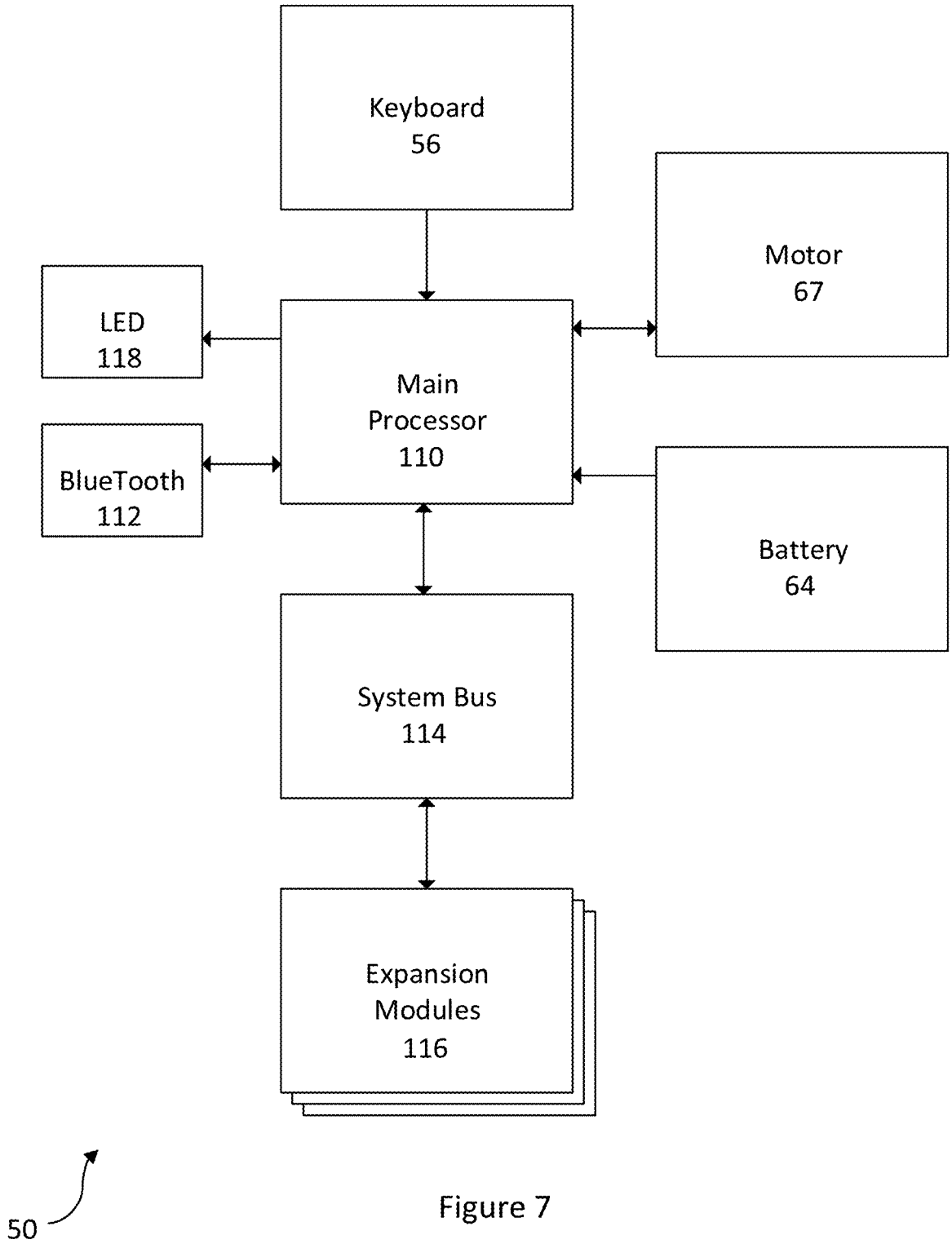
FIG. 7 illustrates a block diagram of an example of an electronic lockbox, in accordance with one embodiment of the present disclosure.
Figure 8:
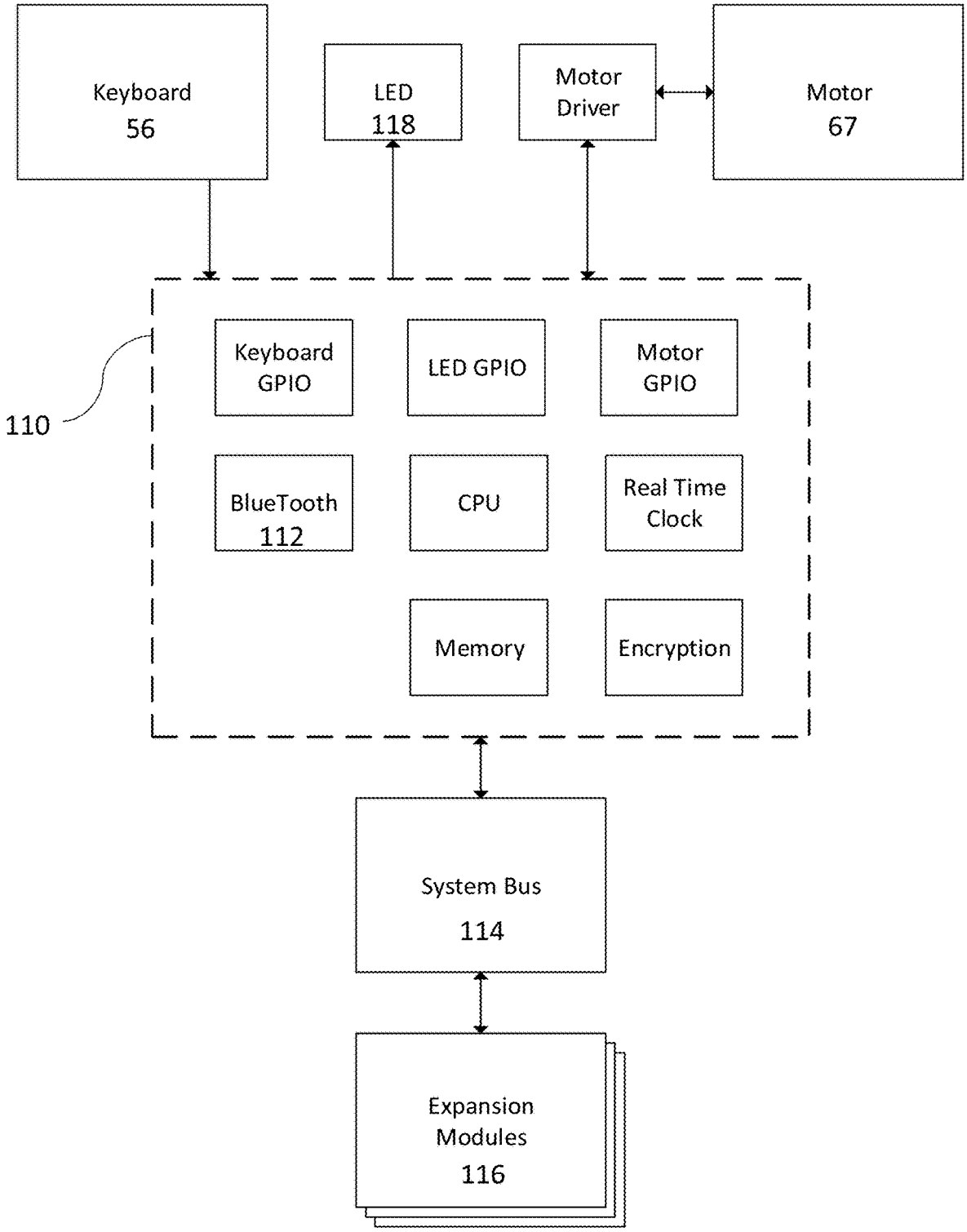
FIG. 8 illustrates another block diagram of an example of an electronic lockbox, in accordance with one embodiment of the present disclosure.

FIGS. 7-8 illustrate examples of block diagrams of electronic lockbox 50, according to some embodiments of the present disclosure. In one example, and referring to FIG. 7, lockbox 50 may include a main processor 110 that is coupled with, directly or indirectly, keyboard 56, motor 67, and battery 64. Processor 110 may also be coupled with LEDs or other audio or visual feedback devices 118, and wireless interface/radio processor 112 to receive and transmit data wirelessly over a wireless communications link (i.e., Bluetooth, LPWAN, Zigbee, or other conventional wireless link). For simplicity of this disclosure, the wireless interface 112 is shown and described herein as a Bluetooth wireless link, but it is understood that other types of conventional or future developed wireless links may be used if desired (such as but not limited to LPWAN, Zigbee or other wireless links). A system bus 114 may be coupled with main processor 110, wherein the system bus 114 is provided to permit connections of one or more expansion modules 116 (described below) for lockbox 50. Referring to FIG. 8, processor 110 may include one or more modules, functional blocks, or integrated portions such as a central processing unit, memory, real-time clock, encryption, Bluetooth interface, keyboard general-purpose I/O, motor general-purpose I/O, and LED general-purpose I/O.

One aspect of embodiments of the present disclosure is that various expansion modules 116 can be connected with the lockbox to provide additional features or functions. Expansion modules 116 may physically attach to the lockbox (for instance, to the back surface of the lockbox) and electronically connect to the lockbox over the system bus 114. In one example, an expansion module that can be connected to the lockbox may include a module for real-time video cameras to take video or images of the surrounding environment outside of the lockbox (such as motion sensing images or other images when the lockbox is moved or the keypad is depressed or when the lockbox is opened or closed); and such images/video can be transmitted by the lockbox over the network to the lockbox owner. Another example of an expansion module can include a power module to provide additional battery/electric power. Another example of an expansion modules may include a mechanical module that provides the lockbox with a lockable/unlockable U-shaped hook to securely latch the lockbox around a door knob if desired (for instance, instead of mounting the lockbox on a wall or surface using screws). Another module may include a sensor to detect the presence or absence of one or more keys, keycards, or other items within the lockbox; and such information can be transmitted by the lockbox over the network to the lockbox owner.

Figure 9:
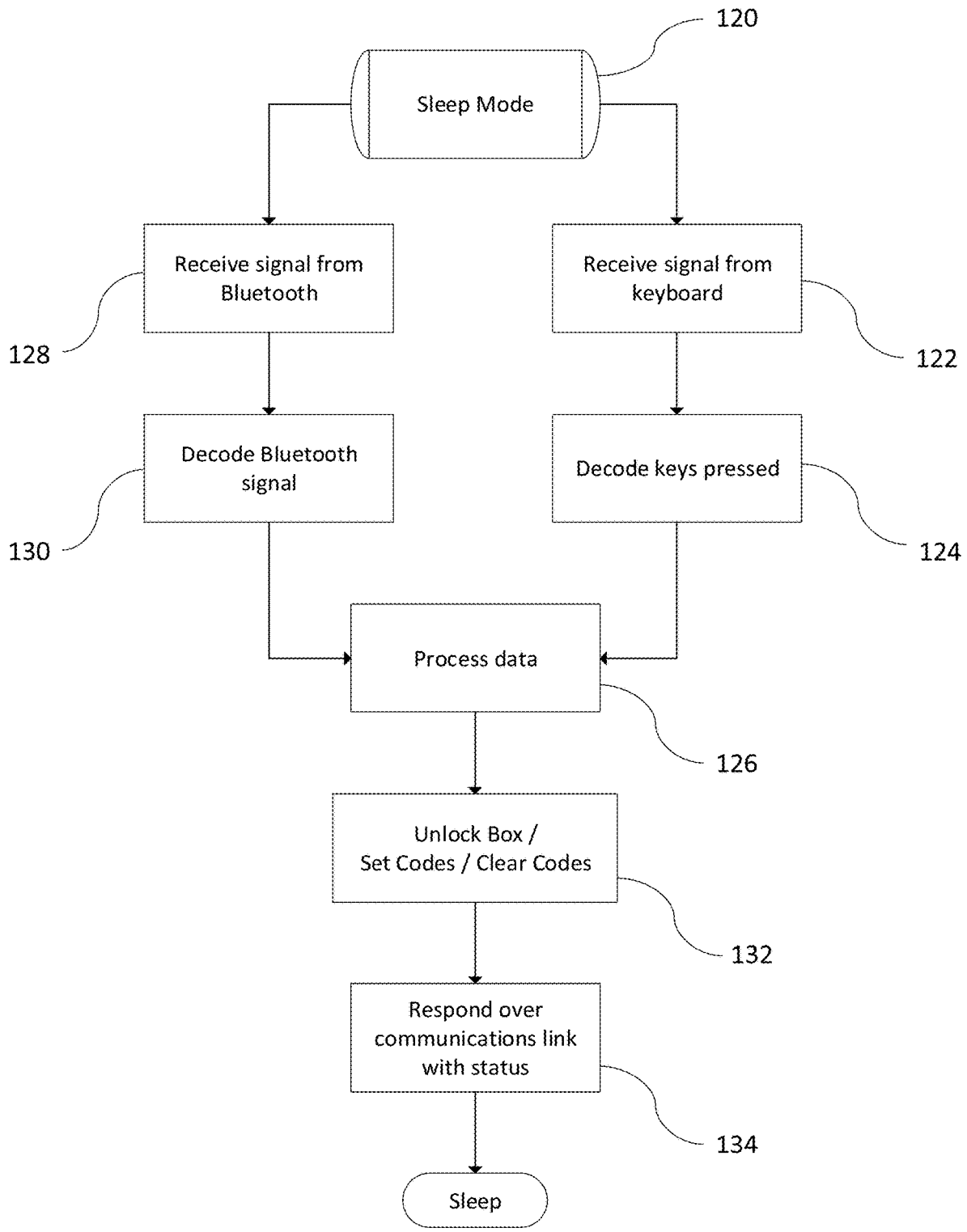
FIG. 9 illustrates an example of a process for an electronic lockbox, in accordance with one embodiment of the present disclosure.

FIG. 9 illustrates an example of operations which may be implemented by lockbox 50, in order to process access codes received, in accordance with one embodiment of the present disclosure. At operation 120, lockbox 50 may be in a sleep mode or low-power mode, and upon receiving a signal from the keyboard such as a depression of one of the keys on the keyboard at operation 122, the lockbox 120 exits the sleep mode and decodes the keys pressed at operation 124. The key code entered into the keyboard is processed at operation 126 to determine whether the entered code is a valid access code. In another example, at operation 128, upon receiving a Bluetooth signal, lockbox 50 exits sleep mode 120 and at operation 130 decodes the received Bluetooth signal. At operation 126, lockbox 50 processes the data contained within the Bluetooth signal to determine if a valid access code was included in the Bluetooth signal. If the entered code is not valid, then the lockbox is not unlocked, and if desired other actions may be taken such as providing feedback that the entered code is invalid, blocking out (after numerous incorrect entries) additional keypad entries, and reporting such incorrect data entries at operation 134. At operation 132, lockbox 50 performs the desired functions if a valid access code was provided—such as but not limited to unlocking the lockbox, setting one or more access codes, clearing one or more access codes, or other functions or operations as described herein. At operation 134, lockbox 50 responds over a communication link with updated status regarding the operations performed at operation 132. For instance, if in response to the access codes received by the lockbox at either operation 122 or 128, the lockbox is unlocked, then at operation 134 the lockbox 50 transmits a message over a communication link regarding the fact that the lockbox status is now "Unlocked."

Figure 10:
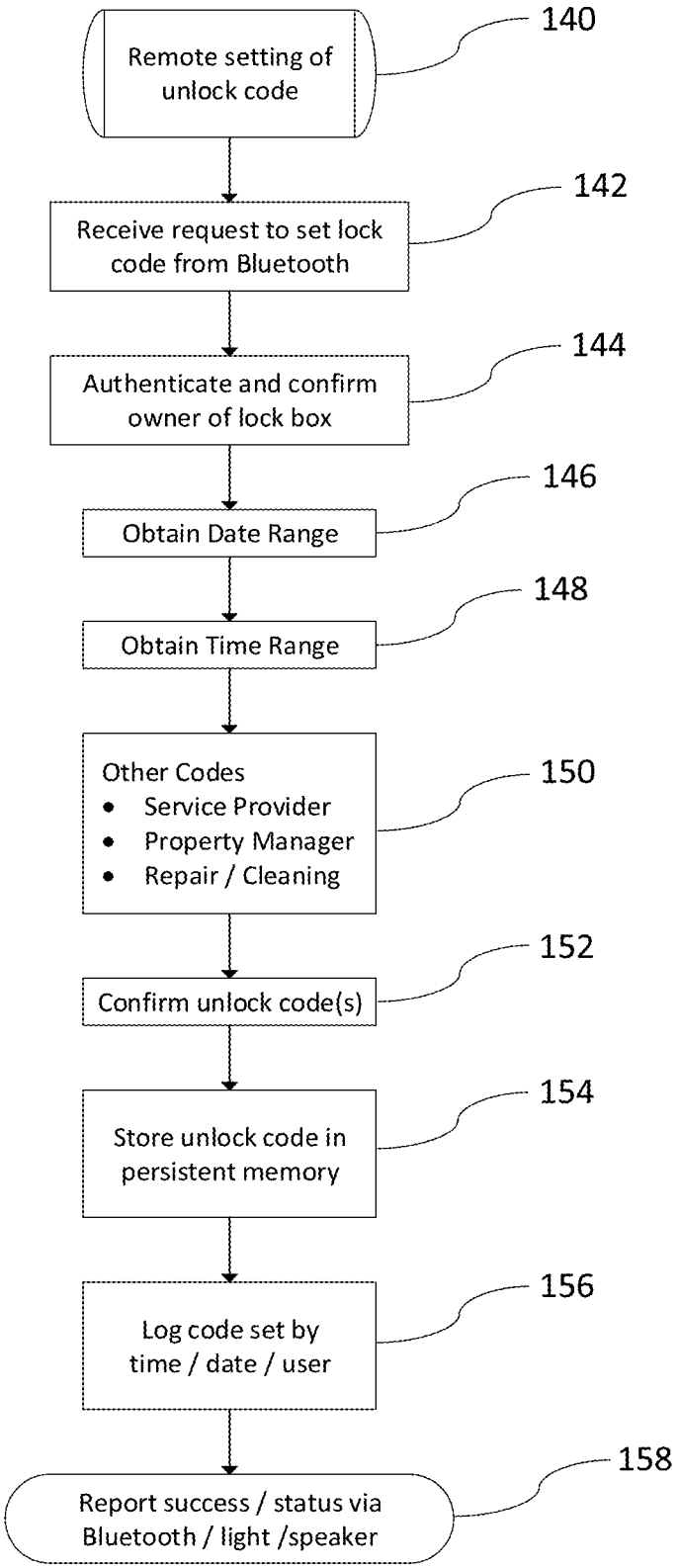
FIG. 10 illustrates an example of a process for remote setting of an unlock code for an electronic lockbox, in accordance with one embodiment of the present disclosure.

FIG. 10 illustrates an example of operations 140 which may be implemented by lockbox 50, in order to remotely set access codes for a lockbox, in accordance with one embodiment of the present disclosure. At operation 142, a request to set access codes may be received via Bluetooth, in one example. At operation 144, the request is authenticated and the owner of the lockbox is confirmed in order to ensure that unauthorized access to the lockbox codes is being prevented. At operation 146, a date range for setting an access code is obtained, and at operation 148 a time range is obtained for setting an access code. For instance, in one example, the request may include to set an access code that is valid every other Saturday from 8 AM to 11 AM in order for a cleaning crew to open the lockbox. At operation 150, codes may be established, for instance, for service providers, property managers, repair or cleaning service providers, or other persons or entities. At operation 152, the unlock codes may be confirmed, and at operation 154 the unlock codes are stored in persistent memory of the lockbox. At operation 156, a log entry is created of the fact that a lock/access code has been set, and at operation 156 a status report of the success of setting the unlock codes is reported via Bluetooth, or by flashing an LED or providing other mode of feedback.

Figure 11:
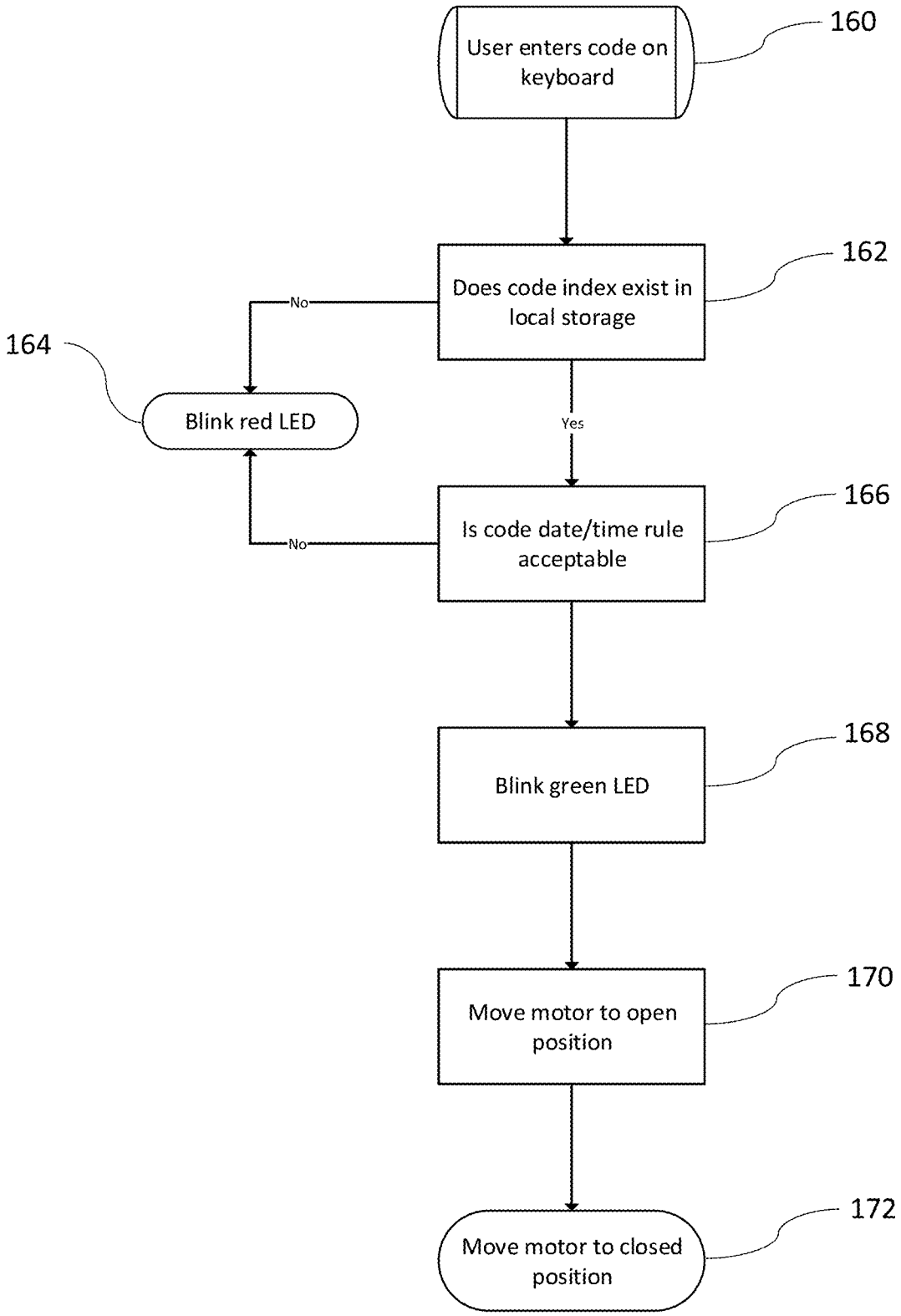
FIG. 11 illustrates another example of a process for an electronic lockbox, in accordance with one embodiment of the present disclosure.

FIG. 11 illustrates an example of operations 160 which may be implemented by lockbox 50, in order to open the lockbox, in accordance with one embodiment of the present disclosure. At operation 162, upon a user entering a code on the keyboard, operation 162 determines whether the entered code exists in local storage. If not, then an LED such as a red LED is flashed to indicate that the code has not been accepted. If the entered code does exist in local storage, then control is passed to operation 166 which determines whether the entered code is valid within the current date and time based upon the access code date and time parameters, and if not, at operation 164 a flashing red LED indicates that the code is not valid. However, if the code is valid, then control is passed to operation 168 where a green LED may be flashed to indicate that the entered access code has been accepted, and at operation 170, the lockbox activates the motor of the electromechanical latch in order to unlock or unlatch the front cover of the lockbox. In one example, at a later time the lockbox may activate the motor at operation 172 to a closed position in order to securely close the lockbox if the latching mechanism does not automatically reset.

Figure 12:
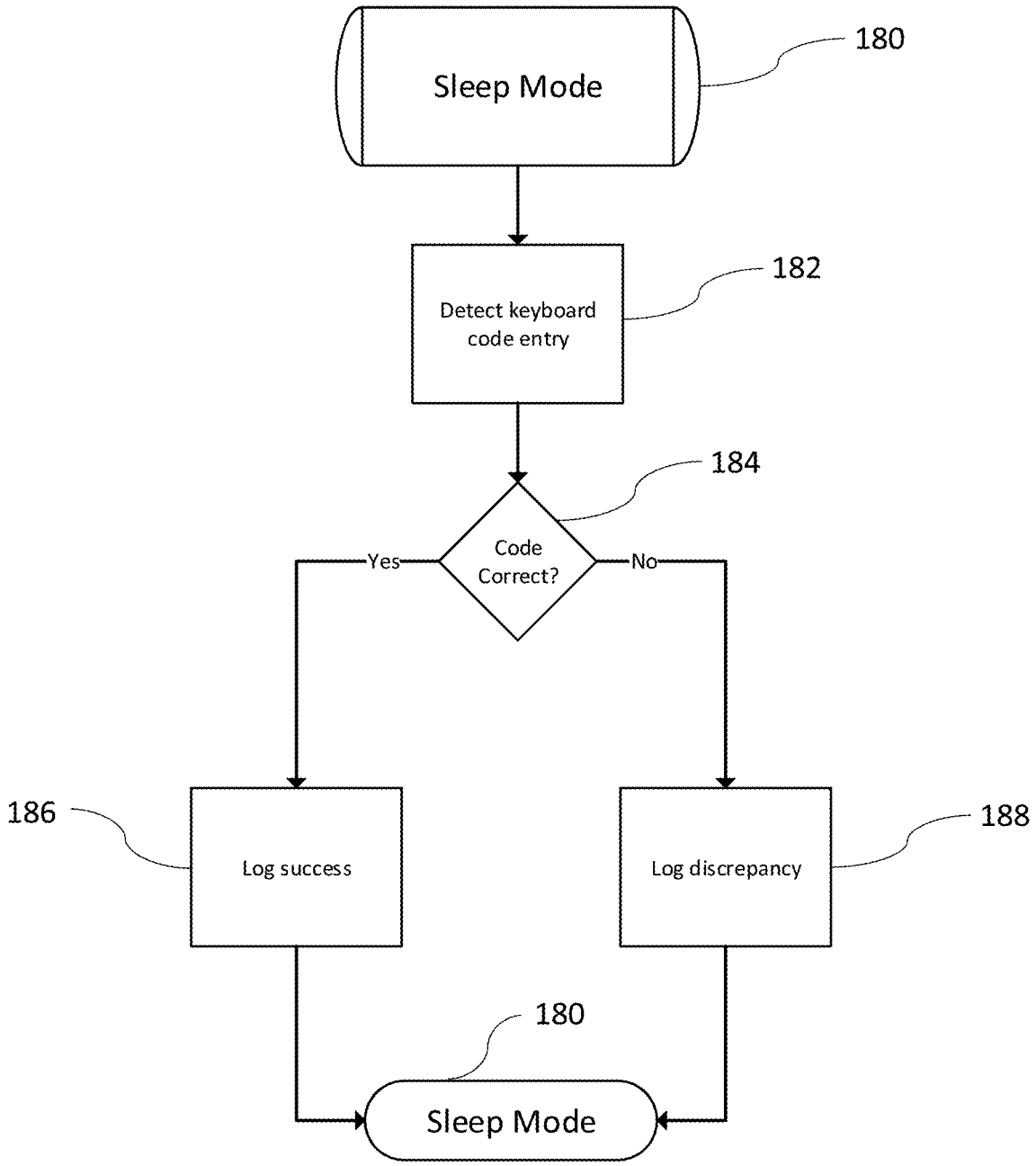
FIG. 12 illustrates another example of a process for an electronic lockbox when a code is entered into a keypad, in accordance with one embodiment of the present disclosure.

FIG. 12 illustrates an example of operations 180 which may be implemented by lockbox 50, to log the codes that are entered, transmitted or typed into the lockbox, in accordance with one embodiment of the present disclosure. At operation 182, the lockbox, coming out of the sleep mode, detects keyboard code entry activity, or may detect an attempted wireless transmission of an access code. At operation 184, the lockbox determines whether the access code is correct. If so, control is passed to operation 186 where the successful receipt of the access code is logged with a date and time stamp, and may be reported if desired. If, however, the access code received at operation 182 is determined by operation 184 to be incorrect, then at operation 188 a log entry is created with the incorrect access code received along with the date and time, and such may also be reported. Upon completion of operations 186 or 188, the lockbox may re-enter a sleep mode.

Figure 13:
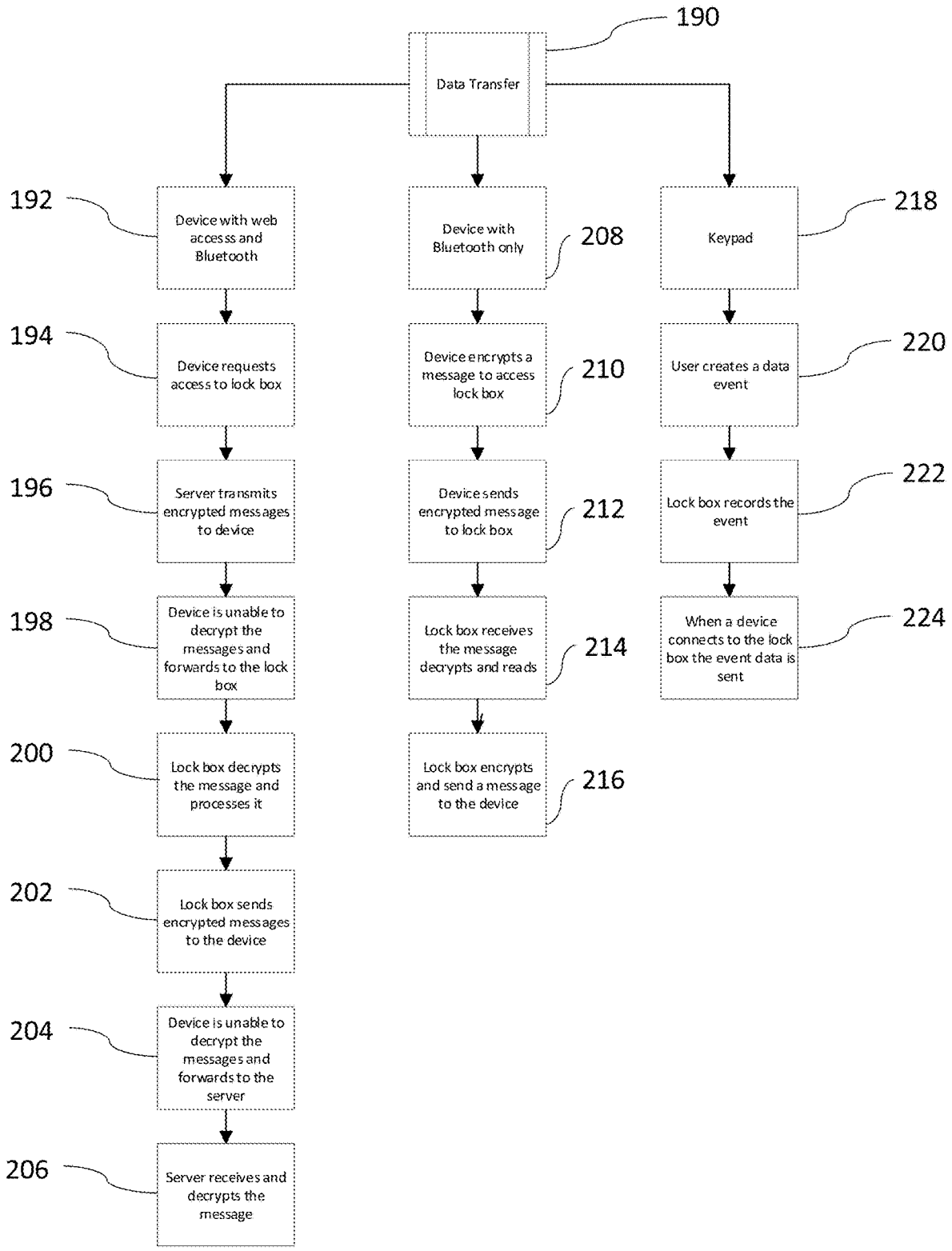
FIG. 13 illustrates various examples processes for an electronic lockbox to transfer data, in accordance with one embodiment of the present disclosure.

FIG. 13 illustrates an example of operations 190 which may be implemented by lockbox 50, in order to transfer data, in accordance with one embodiment of the present disclosure. At operations 192-206, the lockbox can communicate with a device such as a smart phone over a Bluetooth connection, so that the smartphone can be used as a communication bridge to facilitate encrypted communications between the lockbox and an external server. At operation 192, a smartphone device with cellular network access and a Bluetooth connection, requests at operation 194 access to the lockbox. At operation 196, a server transmits encrypted messages to the smart phone device, and at operation 198 assuming the smart phone device is unable to decrypt the messages, the smart phone device forwards the encrypted message to the lockbox. At operation 200, the lockbox receives the encrypted message over Bluetooth and the lockbox decrypts the message and processes the data contained within the message. At operation 202, the lockbox formulates a response message, and encrypts the response message, and sends the encrypted message to the smart phone device. At operation 204, the smart phone device, assuming it is unable to decrypt the encrypted message from the lockbox, forwards the encrypted message to the server. At operation 206, the server receives the encrypted message that was created by the lockbox and decrypts the message. Hence, it can be seen in operations 192-206, that the lockbox can communicate encrypted messages with an external server using the cellular network of a mobile phone over the Bluetooth connection between the mobile phone and the lockbox, in one example.

At operations 208-216, the lockbox can communicate with a device such as a smart phone over a Bluetooth connection. At operation 208, assuming the smart phone device has a Bluetooth connection but does not have an active cellular network connection, then at operation 210, the smart phone device encrypts a message to access the lockbox. At operation 212, the smart phone device sends an encrypted message to the lockbox, and at operation 214 the lockbox receives the encrypted message, and decrypts the message and reads and processes the data contained within the encrypted message. At operation 216, the lockbox formulates a response message, and encrypts the response message and sends the response message to the smart phone device.

At operations 218-224, the lockbox can communicate with a user through the keypad and other LEDs of the lockbox. At operation 218, a user presses one or more keys of the keypad of the lockbox, which, at operation 220, creates a data event. At operation 222, the lockbox records the data received by the user's keypad depressions, and at operation 224, at a later time, when a device connects to the lockbox, the event data is transmitted to the device so that the event can be reported to the lockbox owner if desired, in one example.

Figure 14:
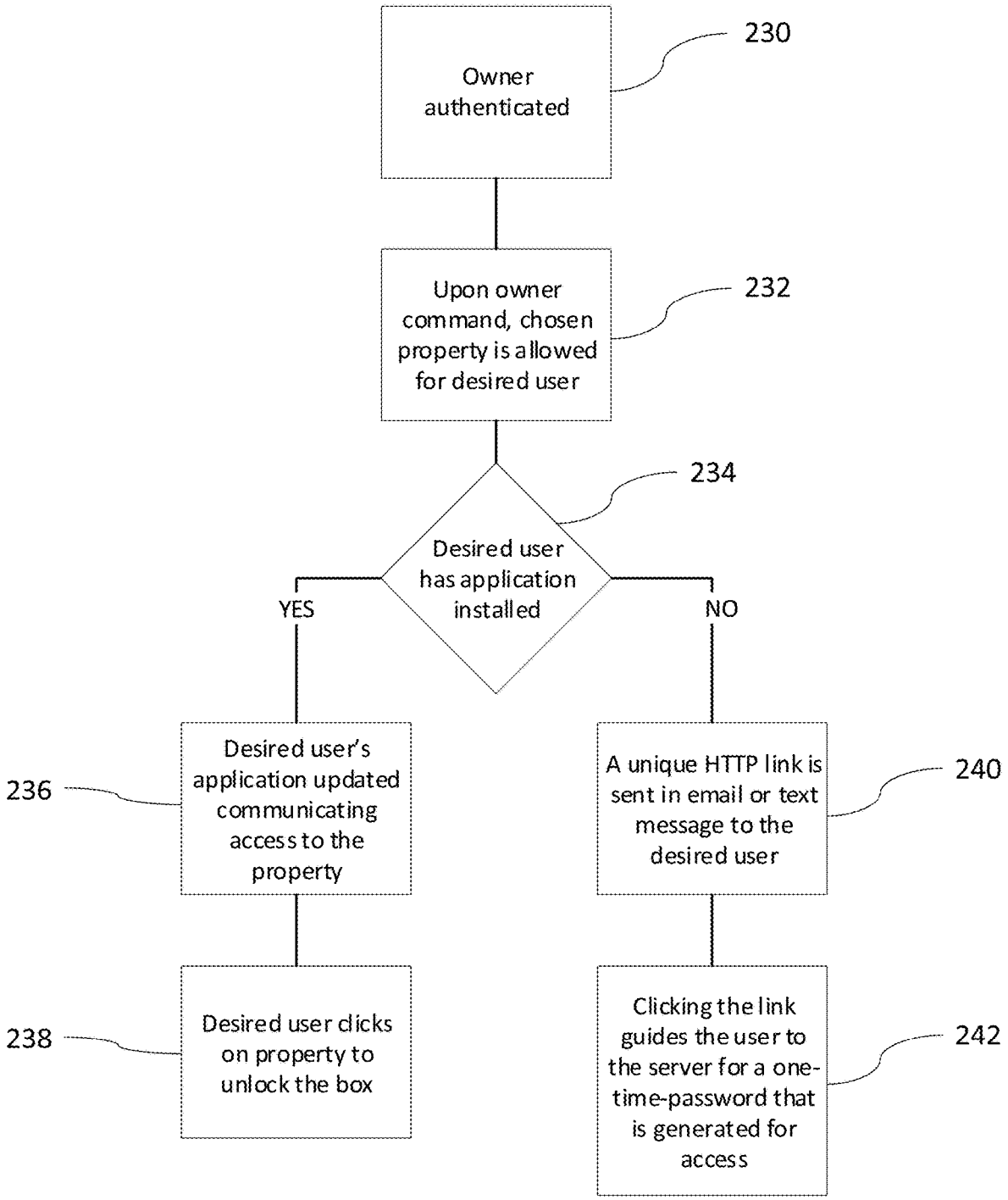
FIG. 14 illustrates an example of a process for a property owner/manager to send an unlock code to a user to unlock an electronic lockbox, in accordance with one embodiment of the present disclosure.

FIG. 14 illustrates an example of operations which may be implemented in a website or application program to control a lockbox, in accordance with one embodiment of the present disclosure. At operation 230, the owner of the lockbox is authenticated, and at operation 232, upon one or more commands by the owner, a chosen property is selected to be provided for authorized access to for a desired user such as a renter or tenant for example. At operation 234, a determination is made whether the desired user has installed an appropriate application program, and if so, control is passed to operation 236. At operation 236, the desired user's application program is updated, communicating to the desired user is that they have access to the lockbox of the property. At operation 238, with the application program running on the user's device (i.e., smartphone) upon the user clicking upon the property, the lockbox is then unlocked. If, however, it is determined at operation 234 that the desired user has not installed the appropriate application program, then in one example, at operation 240, a unique HTTP link is sent in an e-mail or text message to the desired user. At operation 242, upon the user clicking upon the received link, the link guides the user to a server for a one-time password that can be utilized by the user in order to access and unlock the lockbox.

In one example, data encryption may be provided and applied at multiple layers of the lockbox system. For providing encryption at system boot, a TPM chip (Trusted Platform Module, which stores encryption keys for the system) may be provided on the circuit board to hold the device-side certificates for encryption. The operating system can boot/start by using a secret key embedded in a non-readable section (i.e., protected section of fuseable memory that when blown becomes unreadable to the booted OS) of the main processor. This key can be used to decrypt the transmission of data between the TPM and the main processor. The main processor may use a key from the TPM to verify that the operating system of the main processor was not compromised. Once validation is accomplished, the main processor starts the operating system.

In one example, encrypted communication between the main processor and radio processor (i.e., Bluetooth modules) are accomplished over a low-level chip protocol such as but not limited to an I2C interface. Codes stored in the TPM and protected area of the radio processor are used to encrypt traffic sent over the I2C interface. The encryption allows validation and hides content within messages.

In one example, encryption during software upgrades of the main processor or radio processor may be validated against a certificate stored in the TPM chip for the device. This helps ensure the validity of the software before using in a run-time state.

In one example, device user data may be encrypted within data storage (i.e., at rest in flash memory). The TPM module can hold symmetric keys to encrypt the data for writing or reading. Data transmitted from device storage to the server may reside in an encrypted state to ensure secrecy during transmission. Encrypted at rest means the data may not be easily read from the memory.

In one example, data transmitted between the lockbox device and the server may also be encrypted. Due to the varying routes and secondary devices that may exist between both endpoints, encryption such as but not limited to ECDSA (Elliptic Curve Digital Signature Algorithm encryption) or other conventional or future developed encryption may be utilized to ensure communication between both parties is valid and secure. The TPM chip on the device may be used for secure random number generation and certificate storage to ensure security within the device.

As mentioned above, the electronic lockbox 50 may communicate with the smart phone or other mobile device or standalone computing device, in accordance with various embodiments of the present disclosure. In one example, an application program with various graphical user interfaces (GUIs) may be provided so that owners of the lockbox can control the lockbox and can establish a plurality of valid access codes that may be valid at different dates and times for different authorized users. Moreover, an application program may be provided to the users (for example, tenants, renters, service providers, or others) wherein such application program operates on the user's mobile device or smart phone. FIGS. 15-21 illustrate examples of computer display screens that may be implemented in one or more application programs to facilitate one or more features, functions, or operations, of various embodiments of the present disclosure.

Figure 15:
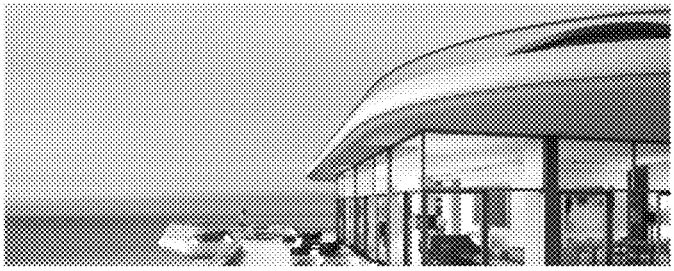
FIG. 15 illustrates an example of a computer display screen which can be provided to a property owner/manager to select a property's electronic lockbox, in accordance with one example of the present disclosure.
Figure 15:
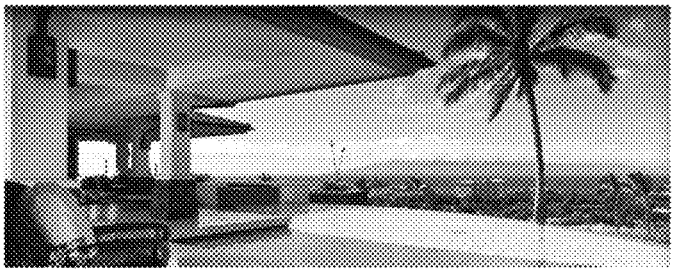
Figure 15:
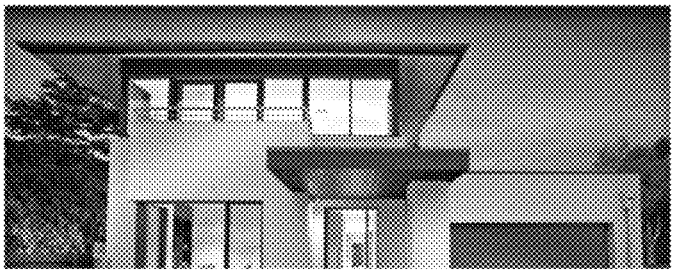
Figure 16:
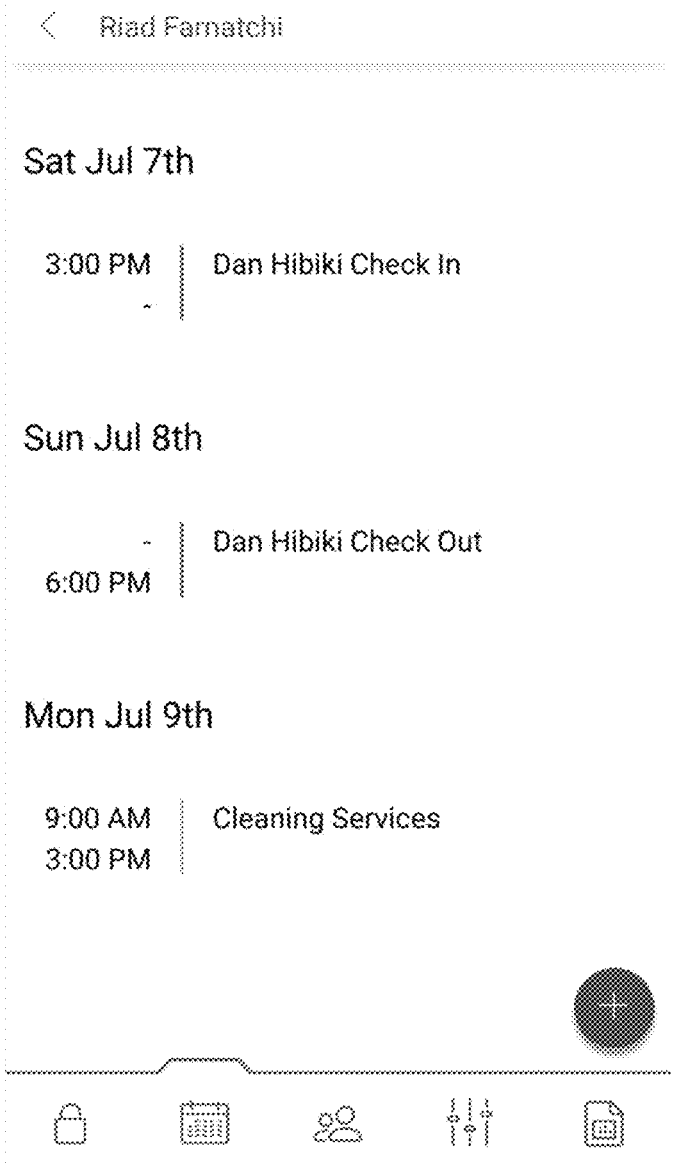
FIG. 16 illustrates an example of a computer display screen which can be provided to a property owner/manager to specify windows of dates/times for setting unlock codes for a property's electronic lockbox, in accordance with one example of the present disclosure.

In FIG. 15, an example of a computer display screen 250 is illustrated wherein a plurality of properties are shown, with each property having a unique lockbox associated with the property, and the computer display screen providing controls for a user (i.e., property owner) to select which lockbox the user desires to interact with, in accordance with one embodiment of the present disclosure. In FIG. 16, assuming the property owner has selected the lockbox at the property "Riad Farnatchi" from FIG. 15, in FIG. 16 an example display screen 260 is shown with a set of calendar dates and times displayed on the computer display screen with authorized user check in and check out times as well as service provider dates and times.

Figure 17:
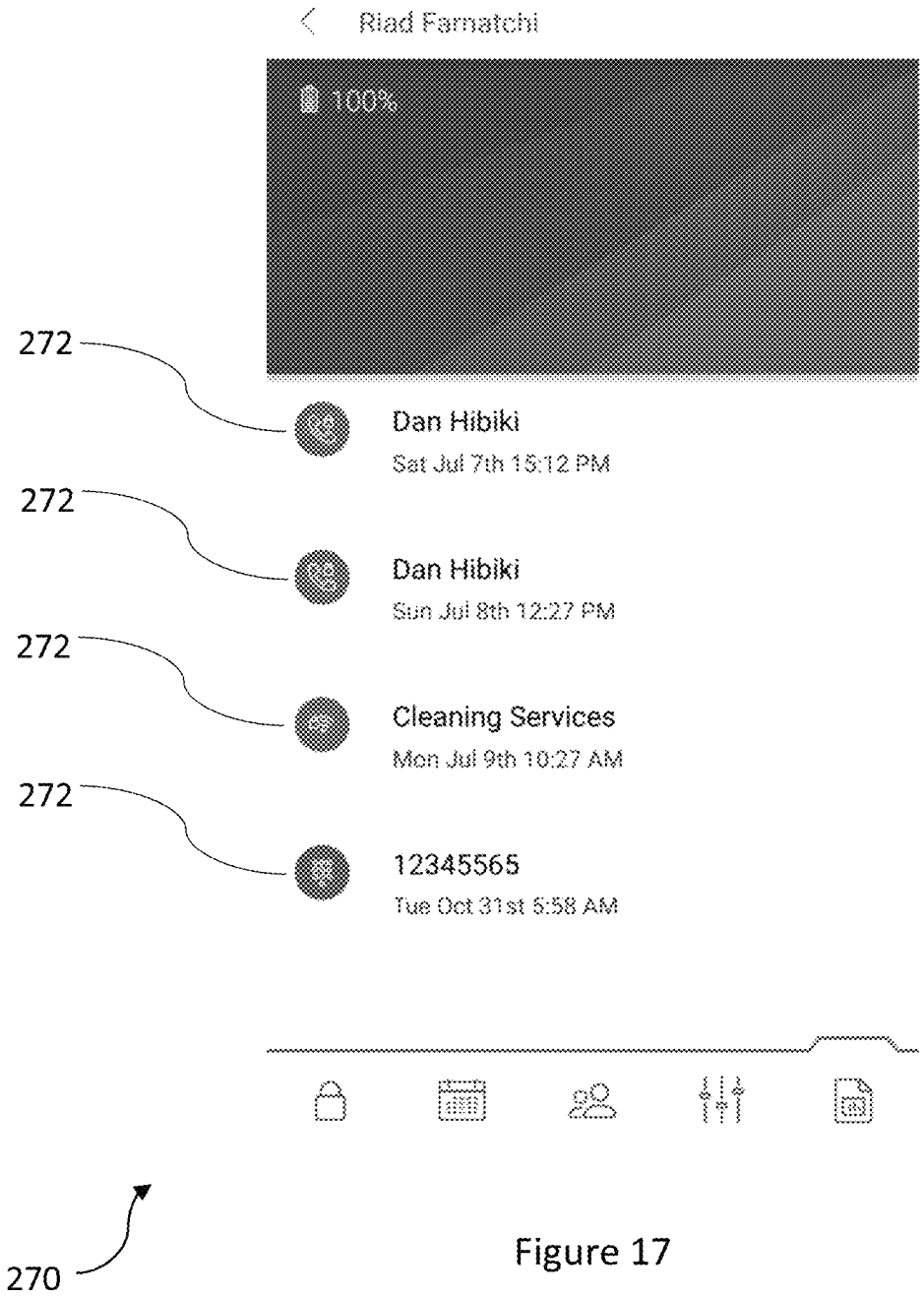
FIG. 17 illustrates an example of a computer display screen which can be provided to a property owner/manager, showing a log of various accesses by users to a property's electronic lockbox, in accordance with one example of the present disclosure.

In FIG. 17, an example of a computer display screen 270 is shown with an event log for the lockbox at the "Riad Farnatchi" property. The event log shows access by authorized users and the date and time stamp of the access, as well as icons 272 indicating whether the access was via smart phone, keypad, or via remote unlock.

Figure 18:
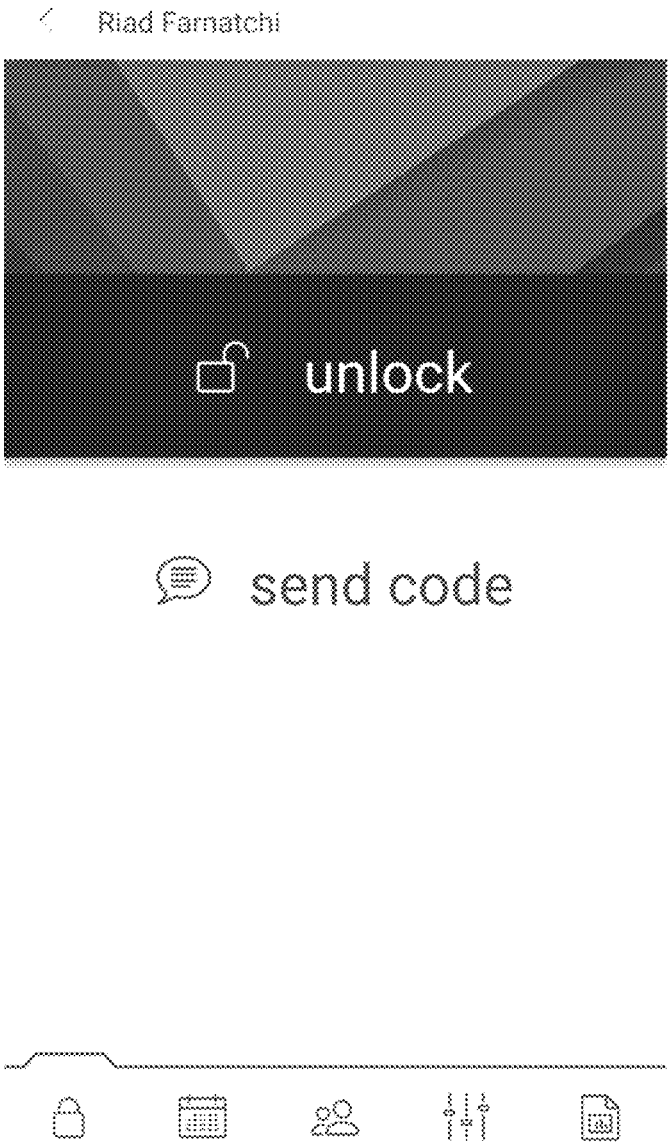
FIG. 18 illustrates an example of a computer display screen which can be provided to a property owner/manager to unlock a property's electronic lockbox or to send an unlock code for the lockbox, in accordance with one example of the present disclosure.

In FIG. 18, an example of a computer display screen 280 for a lockbox owner/property owner is shown, wherein the owner can remotely unlock the lockbox at the property, or can send an encrypted unlock code/access code to an authorized user as desired by the lockbox owner.

Figure 19:
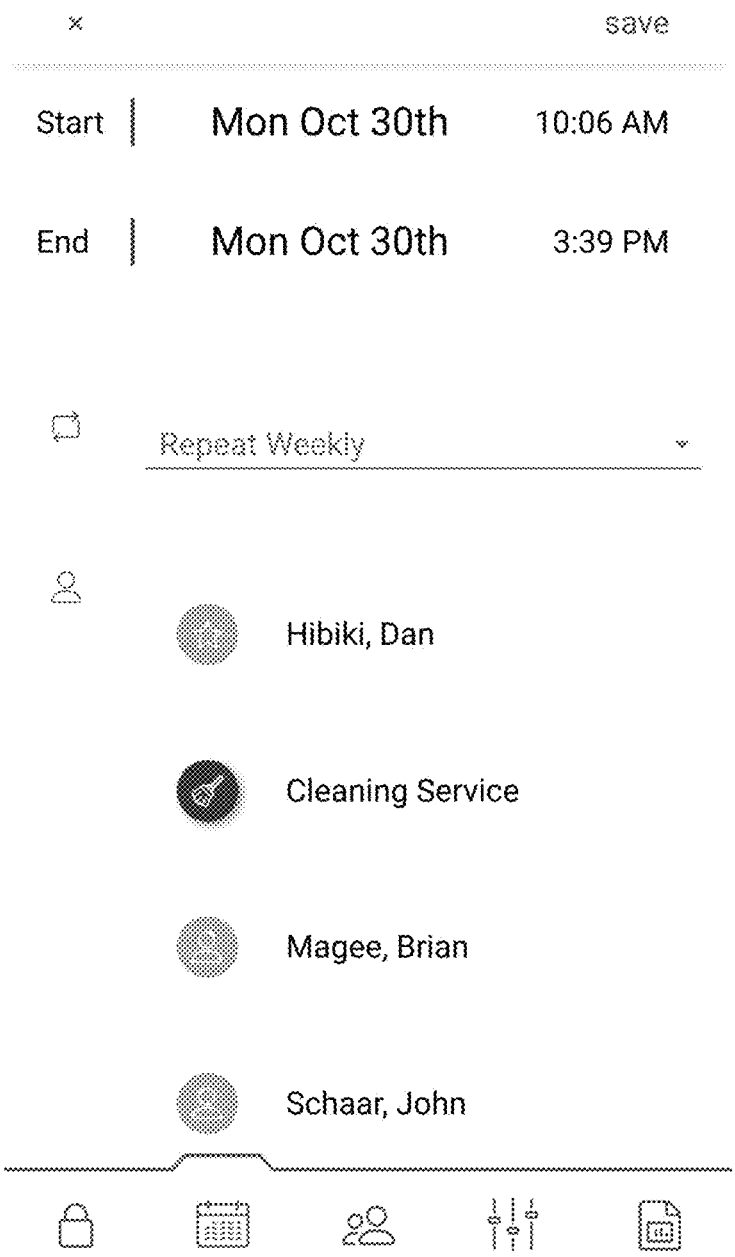
FIG. 19 illustrates an example of a computer display screen which can be provided to a property owner/manager to specify a repeating window of dates/times for use of unlock codes for a user of a property's electronic lockbox, in accordance with one example of the present disclosure.

In FIG. 19, an example of a computer display screen 290 for a lockbox owner/property owner is shown, wherein the owner can set an authorized user to receive an access code that is valid at certain specified dates and times as desired by the lockbox owner.

Figure 20:
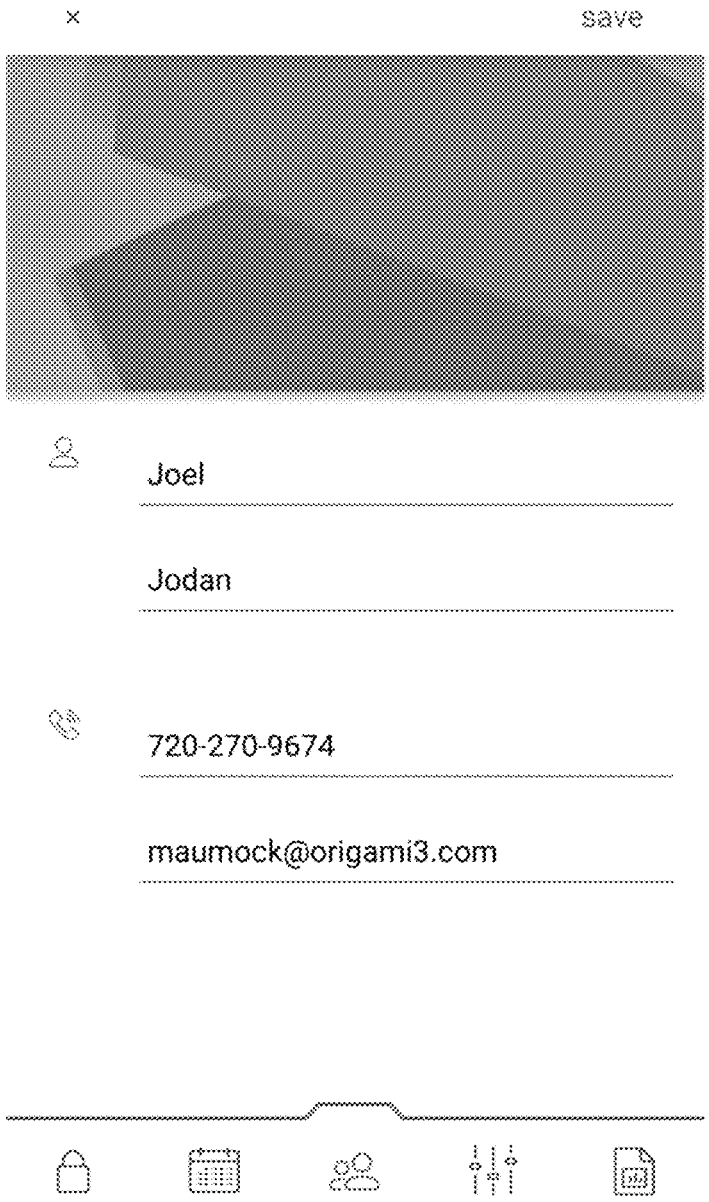
FIG. 20 illustrates an example of a computer display screen which can be provided to a property owner/manager to specify the contact information for users a property's electronic lockbox, in accordance with one example of the present disclosure.
Figure 21:
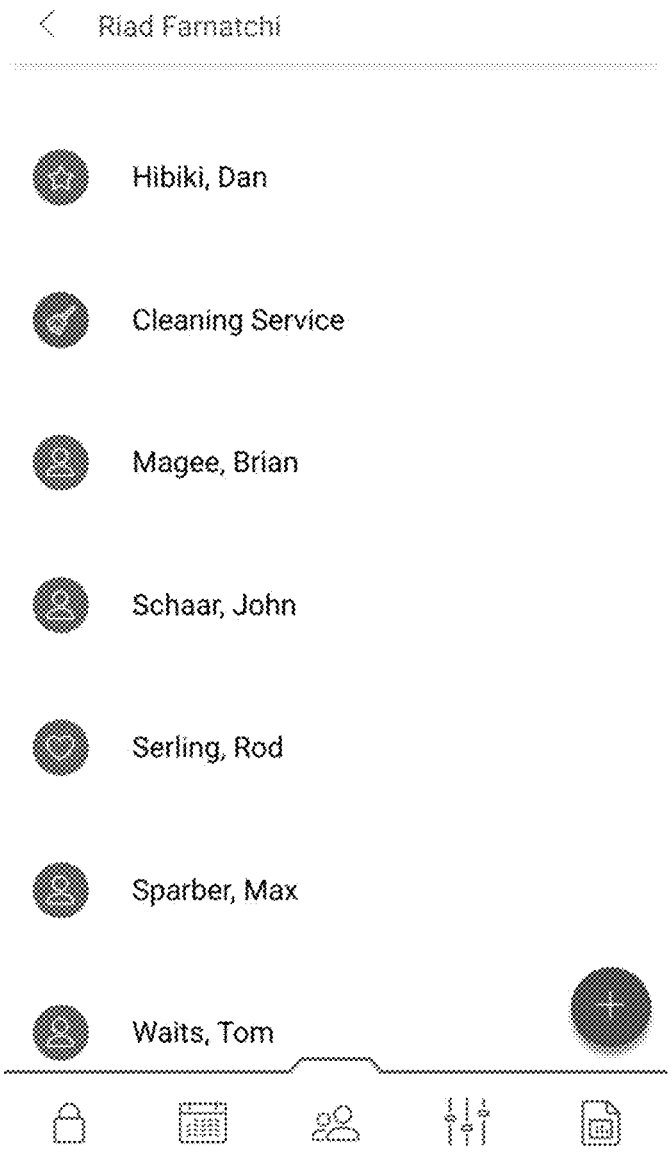
FIG. 21 illustrates an example of a computer display screen which can be provided to a property owner/manager to manage users of a property's electronic lockbox, in accordance with one example of the present disclosure.
Figure 22:
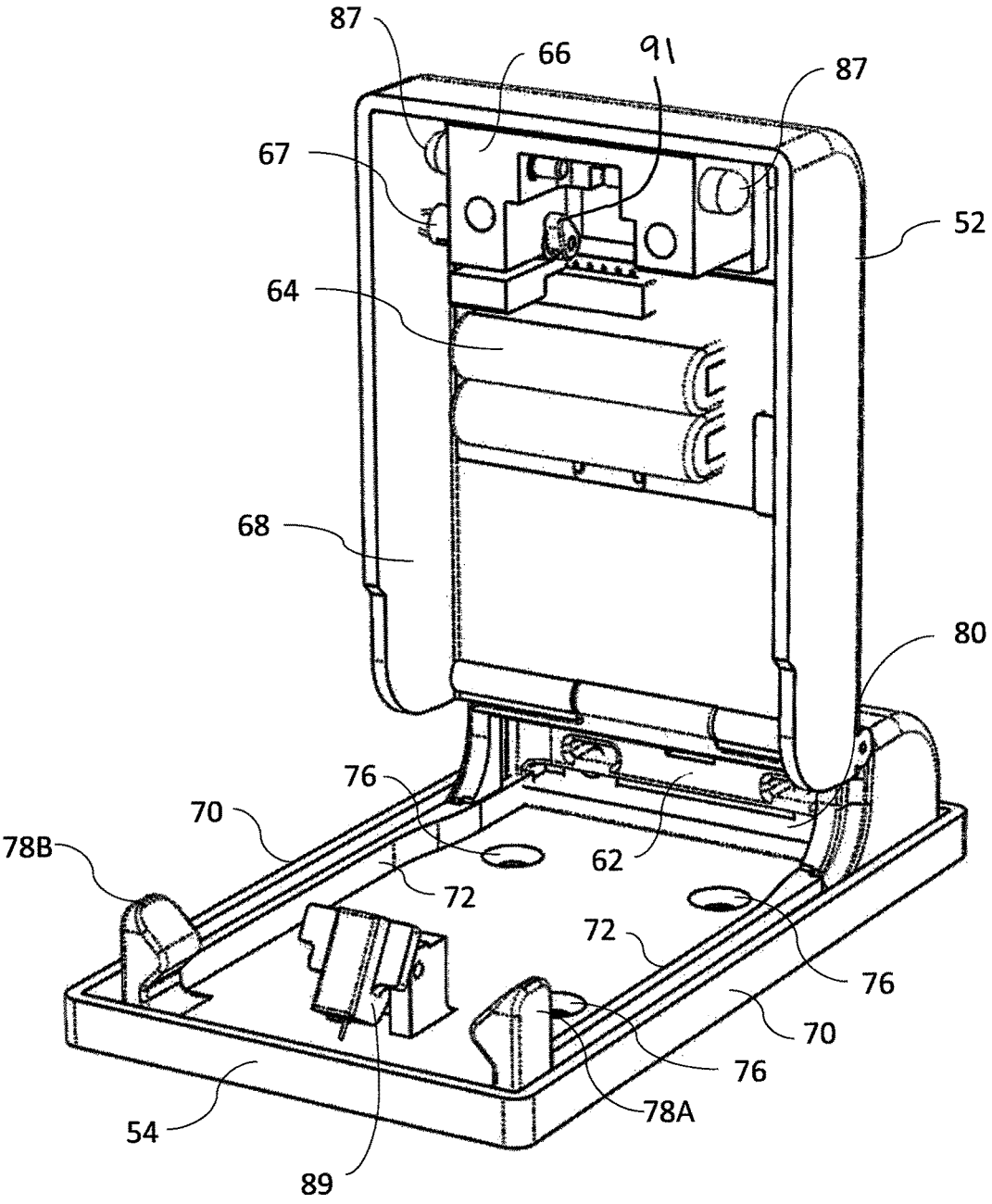
FIG. 22 illustrates an example of an electronic lockbox in an open/unlocked state, in accordance with one embodiment of the present disclosure.
Figure 23:
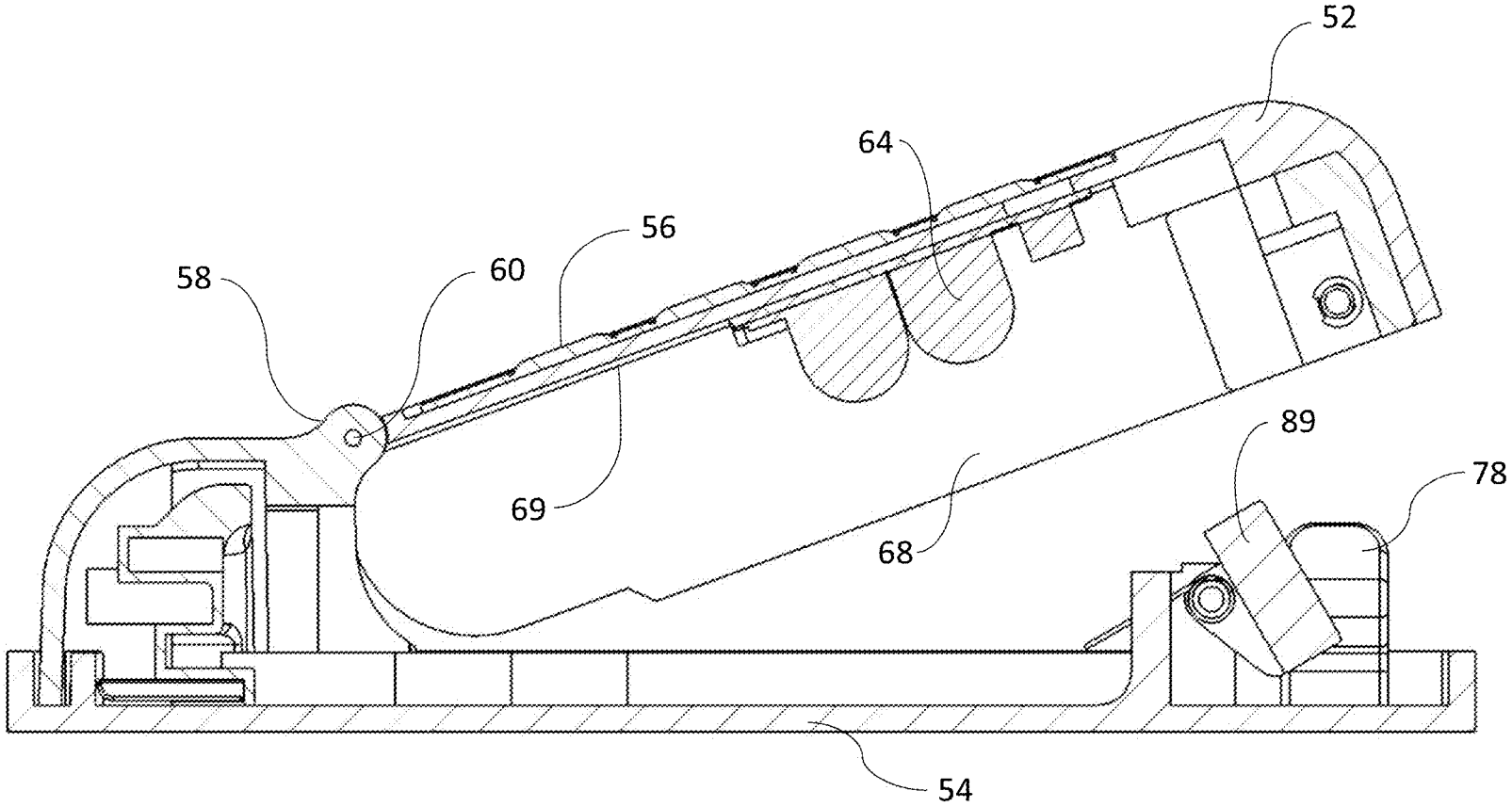
FIG. 23 illustrates a sectional view of an example of an electronic lockbox in an open/unlocked state, in accordance with one embodiment of the present disclosure.
Figure 24:
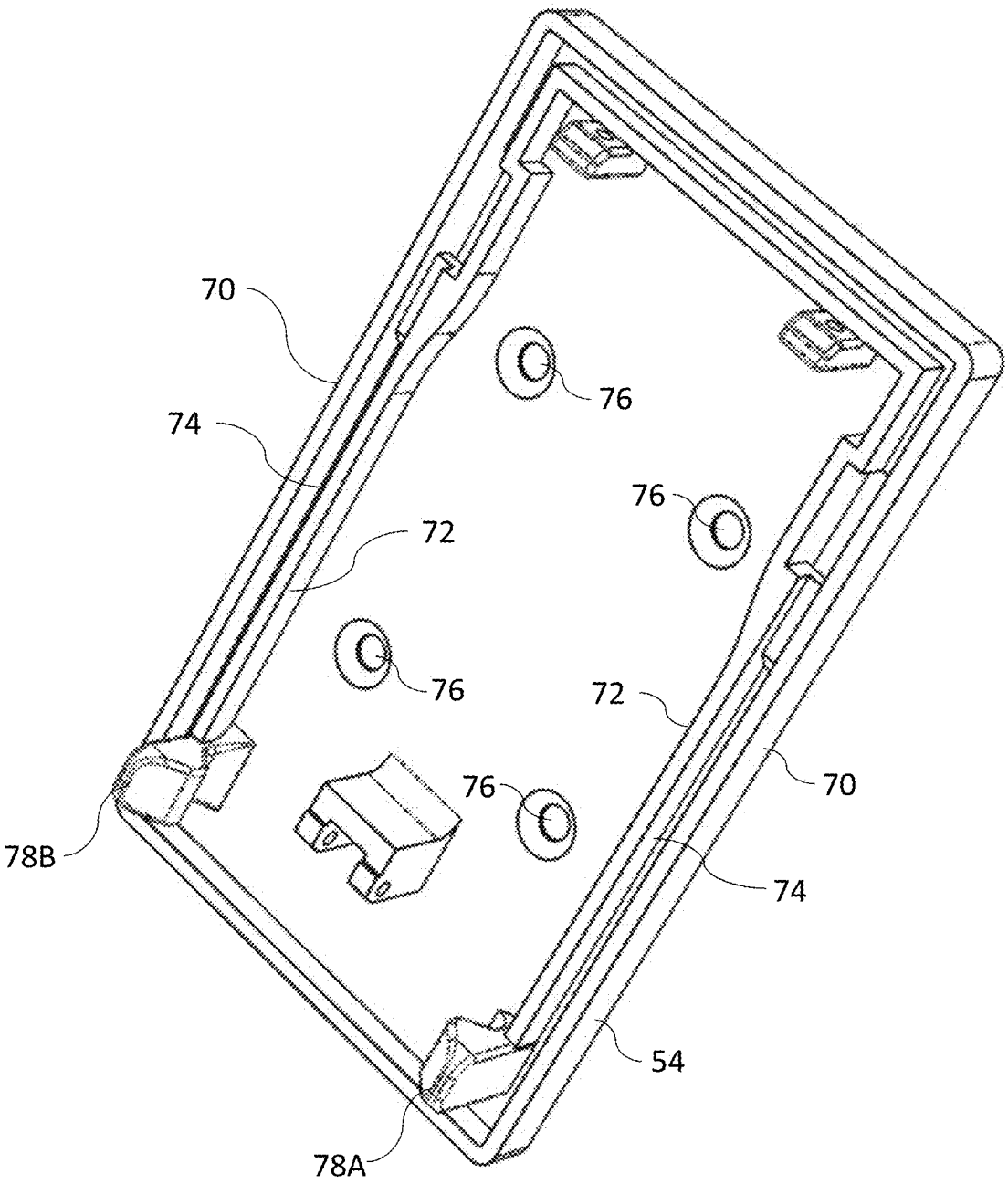
FIG. 24 illustrates an example of a baseplate of an electronic lockbox, in accordance with one embodiment of the present disclosure.

In FIGS. 20-21, example of computer display screens 300, 310 for a lockbox owner/property owner are shown, wherein the owner can set a plurality of authorized users for lockbox access.

The subject matter of this application may be practiced in a variety of embodiments as systems, devices, and other articles of manufacture or as methods. Embodiments (including one or more features of the present disclosure, processes or process steps of the present disclosure, or GUI features shown or described herein) may be implemented as hardware, software, computer readable media, or a combination thereof. The embodiments and functionalities described herein may operate via a multitude of computing systems including, without limitation, desktop computer systems, wired and wireless computing systems, mobile computing systems (e.g., mobile telephones, netbooks, tablets or slate type computers, notebook computers, and laptop computers), hand-held devices, multiprocessor systems, microprocessor-based or programmable consumer electronics, minicomputers, and mainframe computers.

User interfaces and information of various types may be displayed via on-board computing device displays or via remote display units associated with one or more computing devices. For example, user interfaces and information of various types may be displayed and interacted with. Interaction with the multitude of computing systems with which embodiments of the present disclosure may be practiced include, keystroke entry, touch screen entry, voice or other audio entry, gesture entry where an associated computing device is equipped with detection (e.g., camera) functionality for capturing and interpreting user gestures for controlling the functionality of the computing device, and the like.

Furthermore, embodiments of the present disclosure may be practiced in an electrical circuit comprising discrete electronic elements, packaged or integrated electronic chips containing logic gates, a circuit utilizing a microprocessor, or on a single chip containing electronic elements or microprocessors. For example, embodiments of the present disclosure may be practiced via a system-on-a-chip (SOC) where each or many of the illustrated components may be integrated onto a single integrated circuit. Such an SOC device may include one or more processing units, graphics units, communications units, system virtualization units and various application functionality all of which are integrated (or "burned") onto the chip substrate as a single integrated circuit. When operating via an SOC, the functionality described herein with respect to the software applications may be operated via application-specific logic integrated with other components of the computing device on the single integrated circuit (chip). Embodiments of the present disclosure may also be practiced using other technologies capable of performing logical operations such as, for example, AND, OR, and NOT, including but not limited to mechanical, optical, fluidic, and quantum technologies. In addition, embodiments of the present disclosure may be practiced within computers or in any other circuits or systems.

The term computer readable media as used herein may include computer storage media. Computer storage media may include volatile and nonvolatile, removable and non-removable media implemented in any method or technology for storage of information, such as computer readable instructions, data structures, or program modules. The system memory of processor 110 (or other media such as storage devices of computing devices) are all examples of computer storage media (i.e., memory storage). Computer storage media may include random access memory (RAM), read only memory (ROM), electrically erasable read-only memory (EEPROM), flash memory or other memory technology, compact disc read only memory (CD-ROM), digital versatile disks (DVD) or other optical storage, magnetic cassettes, magnetic tape, magnetic disk storage or other magnetic storage devices, or any other article of manufacture which can be used to store information and which can be accessed by a computing device. Any such computer storage media may be part of a computing device.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It should be appreciated that in the foregoing description of exemplary embodiments of the disclosure, various features of the disclosure are sometimes grouped together in a single embodiment, figure, or description thereof for the purpose of streamlining the disclosure and aiding in the understanding of one or more of the various aspects. This method of disclosure, however, is not to be interpreted as reflecting an intention that an embodiment requires more features than are expressly recited in each claim. Rather, inventive aspects lie in less than all features of a single foregoing disclosed embodiment, and each embodiment described herein may contain more than one inventive feature.

It will be understood by those skilled in the art that various changes in the form and details may be made from the embodiments shown and described without departing from the spirit and scope of the disclosure.

The invention claimed is:

1. An electronic lockbox for storing an item, comprising:

a housing defining an interior, the housing including a front cover and a baseplate;

a hinge connecting the front cover with the baseplate; and a key retainer subassembly located within the interior of the housing to store a keycard and one or more keys, the key retainer subassembly including an elongated surface with a first cavity defined in the elongated surface and a plurality of cavities defined in the elongated surface, wherein the first cavity receives an edge of the keycard to store the keycard within the lockbox, and wherein each of said plurality of cavities receives an end of one of said keys to thereby store said one or more keys within the lockbox.

2. The lockbox of claim 1, further comprising:

an electronically controllable latch to selectively secure the cover with the baseplate into a locked state or unlocked state.

3. The lockbox of claim 2, wherein the latch is positioned within the cover.

4. The lockbox of claim 2, wherein the baseplate includes a pair of fixed protruding receiving members; and wherein the latch includes two pins that selectively extend outwardly to engage the fixed protruding receiving members, in order to secure the cover to the baseplate.

5. The lockbox of claim 2, further comprising:

a microprocessor electronically coupled with the latch; and a Bluetooth interface coupled with the microprocessor to receive codes from one or more external devices to control the lockbox.

6. The lockbox of claim 5, wherein the one or more external devices include a user's mobile device.

7. The lockbox of claim 5, wherein the one or more external device includes a gateway device adapted to be coupled with a home's internet connection.

8. The lockbox of claim 5, wherein the lockbox logs one or more codes received by the lockbox, including the date and time said one or more codes were received.

9. The lockbox of claim 8, wherein the lockbox also receives data specifying a date range and a time range associated with said codes.

10. The lockbox of claim 5, further comprising:

an interface bus to couple with a video camera expansion module to capture one or more images of the surrounding environment proximate the lockbox, wherein upon capturing said one or more images, the lockbox transmits the one or more images over a network.

11. An electronic lockbox for storing two or more keys, comprising:

a housing defining an interior, the housing including a front cover and a baseplate;

a key retainer subassembly located within the interior of the housing to store said two or more keys, the key retainer subassembly including an elongated surface having plurality of cavities, wherein each of said plurality of cavities receives an end of one of said keys to store and organize said two or more keys within the lockbox;

a hinge connecting the front cover with the baseplate;

an electronically controllable latch to selectively secure the cover with the baseplate into a locked state or unlocked state;

a microprocessor electronically coupled with the latch; and a wireless interface coupled with the microprocessor to receive codes from one or more external devices to control the lockbox.

12. The lockbox of claim 11, wherein the latch is positioned within the cover;

wherein the baseplate includes at least two fixed protruding receiving members; and wherein the latch includes at least two pins that selectively extend outwardly to engage the fixed protruding receiving members, in order to secure the cover to the baseplate.

13. The lockbox of claim 11, wherein the one or more external devices include a user's mobile device.

14. The lockbox of claim 11, wherein the one or more external devices includes a gateway device adapted to be coupled with a home's internet connection.

15. The lockbox of claim 11, wherein the lockbox logs one or more codes received by the lockbox, including the date and time said one or more codes were received.

16. The lockbox of claim 15, wherein the lockbox also receives data specifying a date range and a time range associated with said codes.

* * * * *